US010509341B2

(12) United States Patent
Tanaka et al.

(10) Patent No.: US 10,509,341 B2
(45) Date of Patent: Dec. 17, 2019

(54) IMAGE FORMING APPARATUS

(71) Applicant: CANON KABUSHIKI KAISHA, Tokyo (JP)

(72) Inventors: Takayuki Tanaka, Tokyo (JP); Shinji Katagiri, Yokohama (JP); Tsuguhiro Yoshida, Yokohama (JP); Shuichi Tetsuno, Kawasaki (JP); Takahiro Ikeda, Oyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/974,116

(22) Filed: May 8, 2018

(65) Prior Publication Data

US 2018/0329334 A1 Nov. 15, 2018

(30) Foreign Application Priority Data

May 9, 2017 (JP) ..... 2017-093326

(51) Int. Cl.

| | |
|---|---|
| ***G03G 15/02*** | (2006.01) |
| ***G03G 21/00*** | (2006.01) |
| ***G03G 15/36*** | (2006.01) |
| ***G03G 15/16*** | (2006.01) |
| ***G03G 21/12*** | (2006.01) |
| ***G03G 15/00*** | (2006.01) |
| ***G03G 15/06*** | (2006.01) |

(52) U.S. Cl.

CPC ..... *G03G 15/0266* (2013.01); *G03G 15/0283* (2013.01); *G03G 15/36* (2013.01); *G03G 21/0011* (2013.01); *G03G 21/0064* (2013.01); *G03G 15/065* (2013.01); *G03G 15/1605* (2013.01); *G03G 15/5004* (2013.01); *G03G 21/12* (2013.01)

(58) Field of Classification Search

CPC ..... G03G 15/0226; G03G 15/36; G03G 15/0283; G03G 15/1605; G03G 15/5004; G03G 21/0011; G03G 21/12

USPC ..... 347/262

See application file for complete search history.

(56) References Cited

U.S. PATENT DOCUMENTS

2010/0202794 A1* 8/2010 Kosaka ..... G03G 15/0409 399/88

2013/0114974 A1* 5/2013 Yoshida ..... G03G 21/0047 399/129

FOREIGN PATENT DOCUMENTS

| | | | |
|---|---|---|---|
| JP | 2004-126202 | A | 4/2004 |
| JP | 2007-4124 | A | 1/2007 |
| JP | 2007-65475 | A | 3/2007 |

* cited by examiner

*Primary Examiner* — Stephen D Meier
*Assistant Examiner* — Alexander D Shenderov
(74) *Attorney, Agent, or Firm* — Canon U.S.A., Inc. I.P. Division

(57) ABSTRACT

A charged positive toner having a positive polarity that attaches to a charge roller is moved from the charge roller to a photosensitive drum, and the positive toner is transferred to an intermediate transfer belt at a primary transfer portion at which a primary-transfer power supply forms an electric potential having a negative polarity. The primary-transfer power supply forms an electric potential having the positive polarity at the primary transfer portion, and the positive toner transferred to the intermediate transfer belt is moved together with the intermediate transfer belt and is collected by the charge roller in contact with a downstream photosensitive drum.

17 Claims, 19 Drawing Sheets

IMAGE FORMING APPARATUS

BACKGROUND OF THE INVENTION

Field of the Invention

The present disclosure relates to an electrophotographic image forming apparatus such as a laser printer, a copying machine, or a facsimile.

Description of the Related Art

A tandem-type image forming apparatus is known as an electrophotographic image forming apparatus and includes image-forming units that are arranged in a conveyance direction of belts such as a conveying belt and an intermediate transfer belt. Each of the image-forming units for respective colors includes a drum-shaped photosensitive member (referred to below as a photosensitive drum) serving as an image-bearing member. Toner images of the respective colors borne by the corresponding photosensitive drums are transferred to a transfer material such as paper or an OHP sheet that is conveyed by a transfer material conveying belt, or are transferred to the transfer material after being transferred to an intermediate transfer belt once, and are subsequently fixed to the transfer material by a fixing unit.

A structure known as a cleanerless structure includes no cleaning device for collecting residual toners (residual transfer toners) on the photosensitive drums after the toner images are transferred from the photosensitive drums to the transfer material or the intermediate transfer belt. With the cleanerless structure, the residual transfer toners move along with the rotation of the photosensitive drums, are collected by a developing device, and are removed from the photosensitive drums. Accordingly, the size of the image forming apparatus can be decreased.

In some cases with the cleanerless structure, however, a part of each residual transfer toner attaches to one of charge members such as charge rollers in contact with the respective photosensitive drums before the residual transfer toner is collected by the developing device. Japanese Patent Laid-Open No. 2004-126202 discloses that cleaning of each charge member is controlled to inhibit a charging failure caused by the toner attached to the charge member in contact with the corresponding photosensitive drum in a manner in which the direction of an electric field is adjusted at each of primary transfer portions formed at the point of contact between the photosensitive drum and the intermediate transfer belt.

However, it is difficult for a structure in Japanese Patent Laid-Open No. 2004-126202 to individually control the direction of the electric field of each primary transfer portion in the case where a common potential formation unit is used to form electric potentials at respective transfer units, and there is the following problem. That is, it is necessary to maintain the direction of the electric field of each primary transfer portion for cleaning control until the toner moved from the charge member of each image-forming unit to the belt passes through the image-forming unit located most downstream in the direction in which the belt moves, and a decrease in the time required for cleaning control is limited.

SUMMARY OF THE INVENTION

The present disclosure provides an image forming apparatus including a first image-bearing member that bears a toner image, a movable belt that is in contact with the first image-bearing member and that forms a first transfer portion, a first charge member that is in contact with the first image-bearing member and that charges the first image-bearing member, a first developing unit that develops an electrostatic latent image formed on the first image-bearing member to form the toner image by using a toner and that can collect at least a charged toner having a first polarity that is a regular charge polarity of the toner among residual toners on the first image-bearing member after the toner passes through the first transfer portion as a result of rotation of the first image-bearing member, a second image-bearing member that is disposed downstream of the first image-bearing member in a direction in which the belt moves, and in contact with the movable belt to form a second transfer portion, a second charge member that is in contact with the second image-bearing member and that charges the second image-bearing member, a second developing unit that develops an electrostatic latent image formed on the second image-bearing member to form a toner image by using a toner and that can collect at least a charged toner having the first polarity among residual toners on the second image-bearing member after the toner passes through the second transfer portion as a result of rotation of the second image-bearing member, a common potential formation unit that forms electric potentials having the same polarity at the first transfer portion and the second transfer portion, and a control unit that controls the first charge member, the second charge member, and the potential formation unit. The control unit controls the first charge member such that a charged first toner that has a second polarity opposite to the first polarity and that attaches to the first charge member is moved to the first image-bearing member, and controls the potential formation unit such that the first toner is transferred from the first image-bearing member to the belt at the first transfer portion and the first toner transferred to the belt is moved to the second image-bearing member at the second transfer portion, and controls the second charge member such that the second charge member collects the first toner moved to the second image-bearing member.

Further features of the present disclosure will become apparent from the following description of exemplary embodiments with reference to the attached drawings.

DESCRIPTION OF THE EMBODIMENTS

Embodiments of the present disclosure will hereinafter be described by way of example with reference to the drawings. The dimensions, materials, shapes, relative positions, and so on of components described according to the embodiments ought to be appropriately changed in accordance with the structures and various conditions of apparatuses for which the disclosure is used. The scope of the disclosure is not limited to the embodiments described below.

First Embodiment

Structure of Image Forming Apparatus

Figure 1:
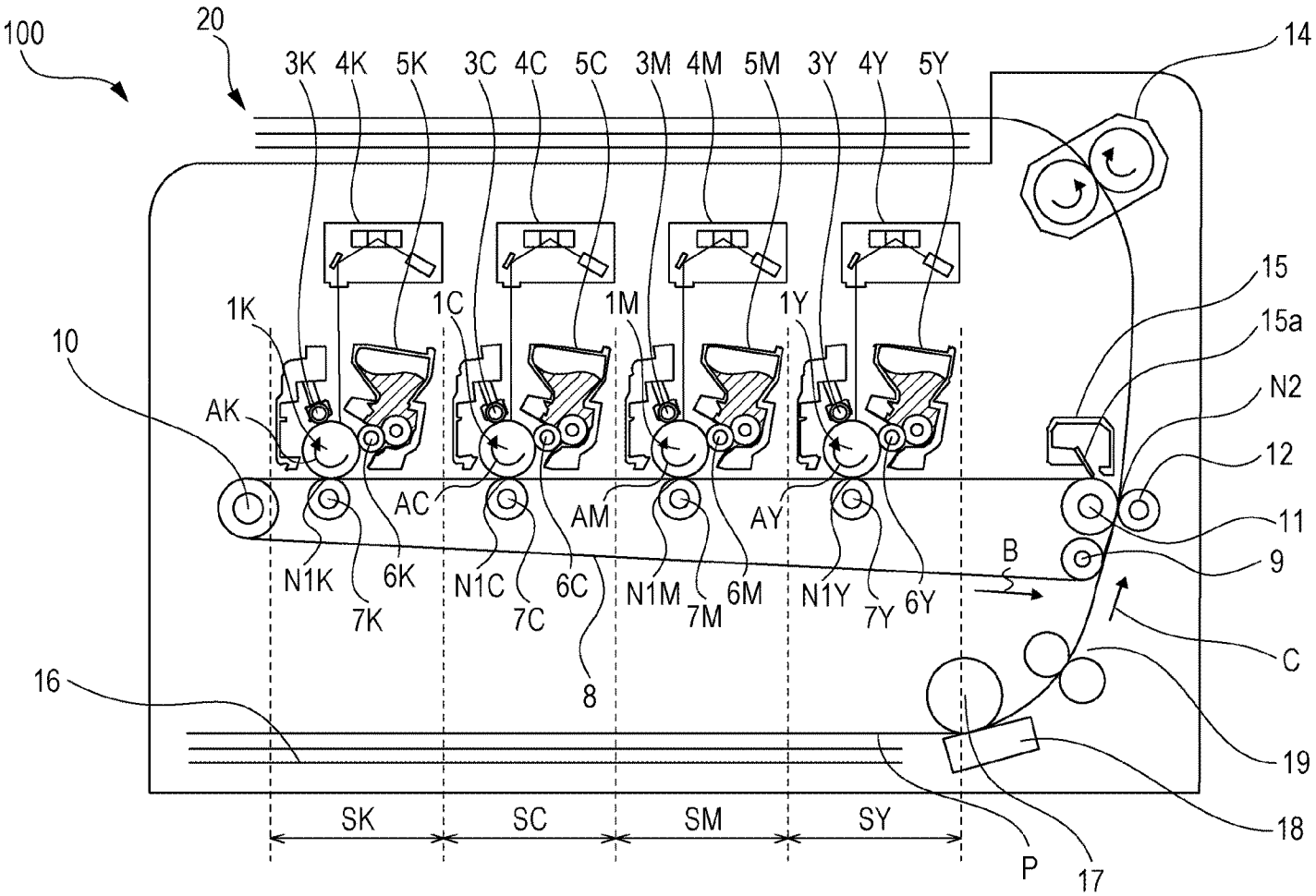
FIG. 1 is a schematic sectional view of the structure of an image forming apparatus according to a first embodiment.
Figure 2:
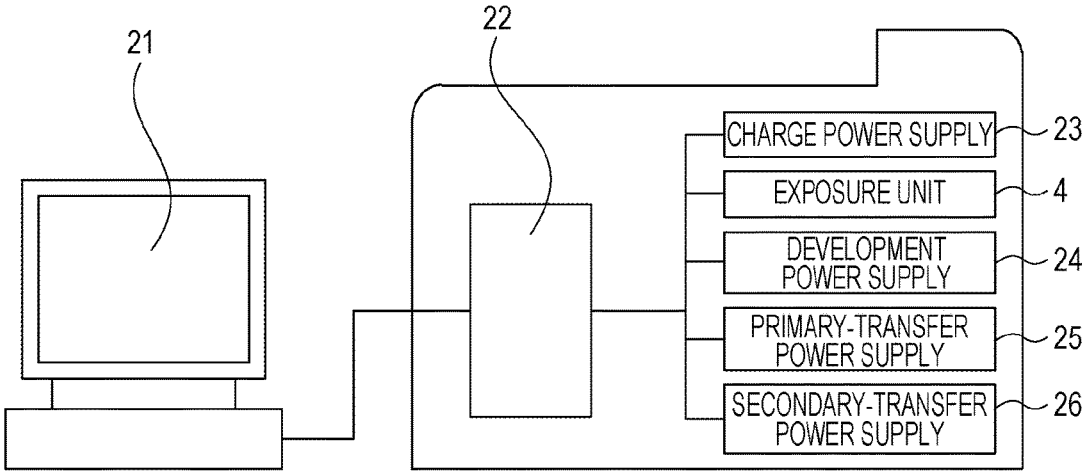
FIG. 2 is a block diagram of a control system of the image forming apparatus according to the first embodiment.

FIG. 1 is a schematic sectional view of the structure of an image forming apparatus 100 according to the present embodiment. FIG. 2 is a block diagram of a control system of the image forming apparatus 100 according to the present embodiment.

As illustrated in FIG. 2, the image forming apparatus 100 is connected to a personal computer 21 that is a host device. An operation-start instruction and image signals are sent from the personal computer 21 to a control circuit 22 serving as a control unit. The control circuit 22 controls various units such that the image forming apparatus 100 forms an image.

As illustrated in FIG. 1, the image forming apparatus 100 according to the present embodiment is a color image forming apparatus including image-forming units SY, SM, SC, and SK that form a yellow (Y) image, a magenta (M) image, a cyan (C) image, and a black (K) image and that are arranged at regular intervals. According to the present embodiment, the structures and operations of the image-forming units SY, SM, SC, and SK are substantially the same except that images of different colors are formed. Accordingly, in the following description, symbols Y, M, C, and K that are added to reference numbers to represent components for the respective colors are omitted when there is no need for particular distinction.

Each image-forming unit S includes a photosensitive drum 1 that is a drum-shaped photosensitive member, a charge roller 3 serving as a charge member, an exposure unit 4, and a development roller 6 serving as a developing unit. Each photosensitive drum 1 is an image-bearing member that bears a toner image and is subjected to a driving force from a drive source (not illustrated) to rotate at a predetermined circumferential velocity (process speed) in the direction of an arrow A (clockwise) in the figure. Each image-forming unit S according to the present embodiment has a so-called cleanerless structure that includes neither a cleaner case nor a cleaning blade that in contact with the photosensitive drum 1 and that collects a toner in the cleaner case.

An intermediate transfer belt 8 is a movable loop belt and is stretched by a drive roller 9, a stretch roller 10, and an opposing roller for secondary-transfer (referred to below as an opposing roller) 11. The drive roller 9 is subjected to a driving force from a drive source (not illustrated) to rotate and moves the intermediate transfer belt 8 in the direction of an arrow B in FIG. 1. The intermediate transfer belt 8 is in contact with each photosensitive drum 1. Primary transfer portions N1 are formed at positions at which the intermediate transfer belt 8 is in contact with each photosensitive drum 1.

A secondary-transfer roller 12 is located so as to face the opposing roller 11 with the intermediate transfer belt 8 interposed therebetween. A secondary transfer portion N2 is formed at a position at which the secondary-transfer roller 12 and the intermediate transfer belt 8 are in contact with each other. A cleaning unit 15 including a cleaning blade 15*a* in contact with the intermediate transfer belt 8 is disposed downstream of the secondary transfer portion N2 in the direction in which the intermediate transfer belt 8 moves.

The circumferential length of the intermediate transfer belt 8 is 680 mm. The distance between the primary transfer portion N1 of each image-forming unit S in the direction in which the intermediate transfer belt 8 moves is 60 mm. The length of the intermediate transfer belt 8 between the most downstream primary transfer portion N1K and the secondary transfer portion N2 is 400 mm. The length of the intermediate transfer belt 8 between the secondary transfer portion N2 and a position at which the intermediate transfer belt 8 and the cleaning blade 15*a* are in contact with each other in the direction in which the intermediate transfer belt 8 moves is 50 mm.

Figure 3:
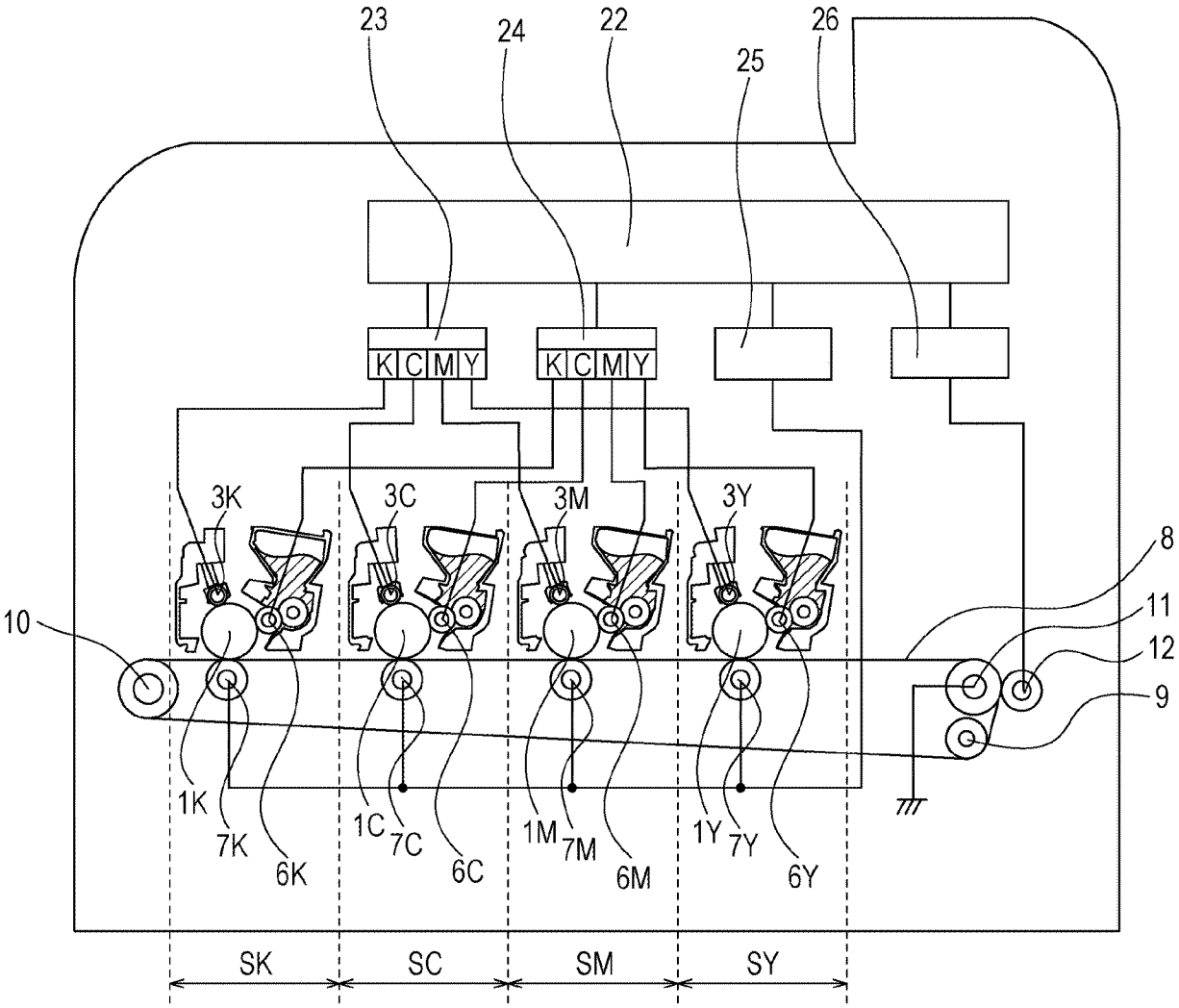
FIG. 3 schematically illustrates electric wiring of the image forming apparatus according to the first embodiment.

FIG. 3 schematically illustrates electric wiring of the image forming apparatus 100 according to the present embodiment. As illustrated in FIG. 3, each charge roller 3 is electrically connected to a charge power supply 23. Each development roller 6 is electrically connected to a development power supply 24. The charge power supply 23 applies a voltage to each charge roller 3 for the corresponding color. The development power supply 24 applies a voltage to each development roller 6 for the corresponding color. In the image forming apparatus 100 according to the present embodiment, the image-forming units S share the charge power supply 23 and the development power supply 24. The present disclosure, however, is not limited thereto. The image-forming units S may use the respective charge power supplies 23 that are individually controlled or may share the development power supply 24.

Primary-transfer rollers 7Y, 7M, 7C, and 7K serving as contact members are connected to a primary-transfer power supply 25 serving as a potential formation unit. During image formation, a common voltage is applied from the primary-transfer power supply 25. The secondary-transfer roller 12 is connected to a secondary-transfer power supply 26. The charge power supply 23, the development power supply 24, the primary-transfer power supply 25, and the secondary-transfer power supply 26 are controlled by the control circuit 22 serving as the control unit.

Image Formation Operation

When the control circuit 22 receives the image signals, an image formation operation starts. Each photosensitive drum 1 is subjected to a driving force from the drive source (not illustrated) to rotate at a predetermined process speed in the direction of the arrow A in FIG. 1. During the rotation, each photosensitive drum 1 uniformly charged by the corresponding charge roller 3 serving as the charge member to which a voltage of −1100 [V] is applied from the charge power supply 23, and a background electric potential of −500[V] is formed uniformly at a surface of each photosensitive drum 1.

Subsequently, each exposure unit 4 exposes the surface of the photosensitive drum 1 of the corresponding image-forming unit S to light at a position at which the toner image is to be formed, and the amount of the light corresponds to a signal based on image information. An electric potential (latent image electric potential) of an electrostatic latent image is formed at the position of each photosensitive drum 1 at which the toner image is to be formed. In the image forming apparatus 100 according to the present embodiment, when each exposure unit 4 exposes the surface of the corresponding photosensitive drum 1 to light in the maximum amount, the surface potential of the exposed portion decreases to about −100 [V].

A charged toner having a negative polarity, which is the regular charge polarity of the toner, attaches to each development roller 6 serving as the developing unit that can come into contact with and separate from the corresponding photosensitive drum 1. A voltage of −300 [V] is applied from the development power supply 24 to each development roller 6. This forms an electric field in the direction in which the toner moves from each development roller 6 to the corresponding photosensitive drum 1 between the development roller 6 and the position of the photosensitive drum 1 at which the latent image electric potential is formed. The electric field causes the toner that attaches to each development roller 6 to move to the position of the corresponding photosensitive drum 1 at which the latent image electric potential is formed. The toner image corresponding to the electrostatic latent image is developed on each photosensitive drum 1.

Subsequently, the toner image formed on each photosensitive drum 1 is primarily-transferred from the photosensitive drum 1 to the intermediate transfer belt 8 when the toner image passes through the corresponding primary transfer portion N1 at which the photosensitive drum 1 and the intermediate transfer belt 8 are in contact with each other. At this time, a voltage of +600 [V] is applied from the primary-transfer power supply 25 to the primary-transfer roller 7 of each image-forming unit S. While the intermediate transfer belt 8 moves, the toner image is primarily-transferred from each photosensitive drum 1 to the intermediate transfer belt 8, and each toner image is superposed thereon in order at the primary transfer portion N1 of the corresponding image-forming unit S. A multicolor toner image corresponding to a target color image is formed on the intermediate transfer belt 8.

The image forming apparatus 100 according to the present embodiment has the cleanerless structure. That is, each image-forming unit S includes no cleaning blade serving as the contact member in contact with the corresponding photosensitive drum 1 between the primary transfer portion N1 and the position at which the photosensitive drum 1 and the corresponding charge roller 3 are in contact with each other with respect to the direction in which the photosensitive drum 1 rotates. Accordingly, a residual transfer toner on each photosensitive drum 1 after the toner image is primary-transferred from the photosensitive drum 1 to the intermediate transfer belt 8 is collected by the corresponding developing unit 6 after the residual transfer toner passes through a charging portion at which the corresponding charge roller 3 and the photosensitive drum 1 are in contact with each other. At this time, each photosensitive drum 1 is charged and exposed to light by the corresponding charge roller 3 and exposure unit 4 again while rotating, and the electrostatic latent image is formed on the surface of the photosensitive drum 1 in accordance with the image information.

Simultaneously with the image formation operation, a feed roller 17 feeds transfer materials P accommodated in a sheet feed tray 16 to the secondary transfer portion N2. At this time, one of the transfer materials P to be fed from the sheet feed tray 16 is separated due to friction between the feed roller 17 and a separating pad 18 and is conveyed in the direction of an arrow C in FIG. 1 after a skew is adjusted by conveyance rollers 19.

The multicolor toner image formed on the intermediate transfer belt 8 reaches the secondary transfer portion N2 as the intermediate transfer belt 8 moves. A voltage of +1500 [V] is applied from the secondary-transfer power supply 26 to the secondary-transfer roller 12, and the multicolor toner image borne by the intermediate transfer belt 8 is secondary-transferred to the transfer material P conveyed to the secondary transfer portion N2 by the conveyance rollers 19. Subsequently, the transfer material P to which the multicolor toner image is secondary-transferred is conveyed to a fixing unit 14, the multicolor toner image is fixed to the transfer material P by being pressurized and heated, and is subsequently discharged into a sheet discharge tray 20.

The secondary-transfer roller 12 serving as a secondary transfer member is in contact with the outer circumferential surface of the intermediate transfer belt 8 and forms the secondary transfer portion N2. The secondary-transfer roller 12 is connected to the secondary-transfer power supply 26. When the secondary-transfer power supply 26 applies a voltage to the secondary-transfer roller 12, the toner image is secondary-transferred from the intermediate transfer belt 8 to the transfer material P at the secondary transfer portion N2.

A residual toner on the intermediate transfer belt 8 after the secondary transfer is collected by the cleaning unit 15. The cleaning unit 15 collects the residual toner on the intermediate transfer belt 8 in a manner in which an edge of the cleaning blade 15*a* is brought into contact with the intermediate transfer belt 8 that rotationally moves.

Attachment of Toner to Charge Roller

After the toner image is primary-transferred from each photosensitive drum 1 to the intermediate transfer belt 8, the residual transfer toner on the photosensitive drum 1 contains a charged toner having the negative polarity (first polarity), which is the regular polarity of the toner, and a charged toner having a positive polarity (second polarity) in some cases. The residual transfer toner is often charged to have the negative polarity. However, when an electric potential difference between each photosensitive drum 1 and the intermediate transfer belt 8 is large and an electric discharge occurs at the primary transfer portion N1, the polarity of a part of the toner is reversed due to the electric discharge, and the part is charged to have the positive polarity. The charged toner having the negative polarity is referred to below as a negative toner, and the charged toner having the positive polarity is referred to below as a positive toner.

During the image formation, a voltage of −1100 [V] is applied to each charge roller 3. Accordingly, the positive toner of the residual transfer toner that has moved to the charging portion as a result of rotation of each photosensitive drum 1 is attracted to the corresponding charge roller 3 at the charging portion. That is, the electric field formed between each photosensitive drum 1 and the corresponding charge roller 3 causes the positive toner to attach to the charge roller 3, and the negative toner passes through the charging portion. Subsequently, the negative toner moves from each photosensitive drum 1 to the corresponding development roller 6 at a position at which the photosensitive drum 1 and the development roller 6 are in contact with each other.

Regarding the direction in which the intermediate transfer belt 8 moves, a phenomenon called a re-transfer occurs in the tandem-type image forming apparatus 100 including the photosensitive drums 1Y, 1N, 1C, and 1K that bear the toner images having the respective different colors. The re-transfer is a phenomenon in which the toner images transferred from the upstream photosensitive drum 1Y, 1M, and 1C to the intermediate transfer belt 8 pass through the positions at which the downstream photosensitive drums 1M, 1C, and 1K and the intermediate transfer belt 8 are in contact with each other, and at this time, the toner images move to the downstream photosensitive drums 1M, 1C, and 1K.

At each primary transfer portion N1, an electric discharge occurs due to an electric potential difference between the corresponding photosensitive drum 1 and the intermediate transfer belt 8 in some cases. When the toner images transferred from the upstream photosensitive drums 1Y, 1M, and 1C to the intermediate transfer belt 8 are subjected to the electric discharge, the polarity of a part of the toner of each toner image is reversed, and the part becomes the positive toner and is re-transferred from the intermediate transfer belt 8 to the corresponding photosensitive drum 1. Subsequently, the positive toner that is re-transferred to the photosensitive drum 1 moves while the photosensitive drum 1 rotates, and attaches to the corresponding charge roller 3 from the photosensitive drum 1 at the charging portion. The amount of the positive toner that attaches to the charge roller 3 due to the re-transfer increases as the corresponding image-forming unit S is nearer to the most downstream side in the direction in which the intermediate transfer belt 8 moves. The amount of the positive toner that attaches to the charge roller 3K of the image-forming unit SK is largest.

Discharge of Positive Toner

The toner that attaches to each charge roller 3 serving as the charge member changes the charging performance of the charge roller 3 and makes it difficult to uniformly charge the corresponding photosensitive drum 1, and there is a risk of the occurrence of a defective image. In view of this, according to the present embodiment, the positive toner that attaches to each charge roller 3 is discharged while images are continuously formed on the transfer materials P (sheet interval), and this inhibits the charging performance of the charge roller 3 from decreasing. The following description with reference to FIG. 4 to FIG. 6 contains the detail of discharge of a positive toner Q from each charge roller 3 according to the present embodiment when the images are continuously formed on the transfer materials P.

Figure 4:
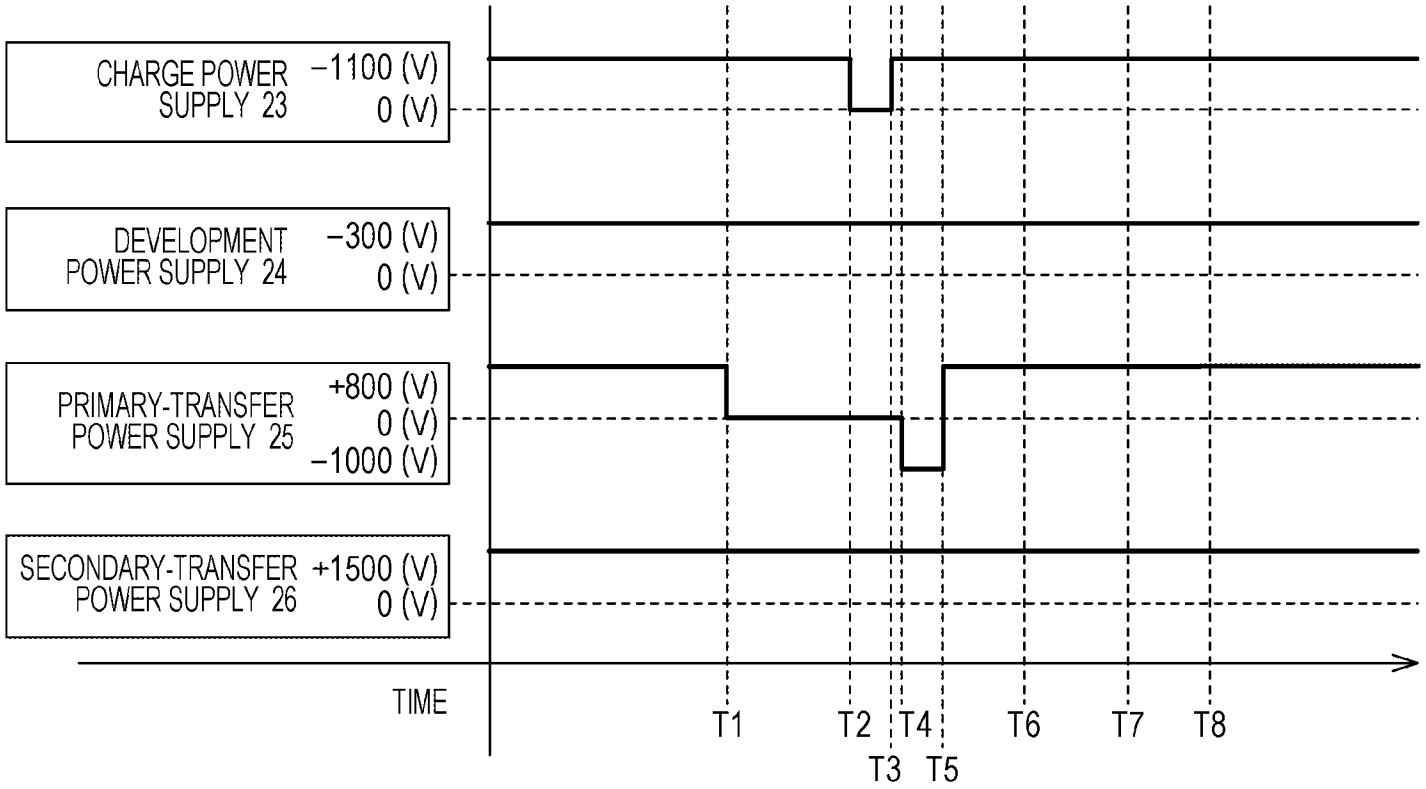
FIG. 4 is a timing chart of discharge of a positive toner according to the first embodiment.
Figure 5A:
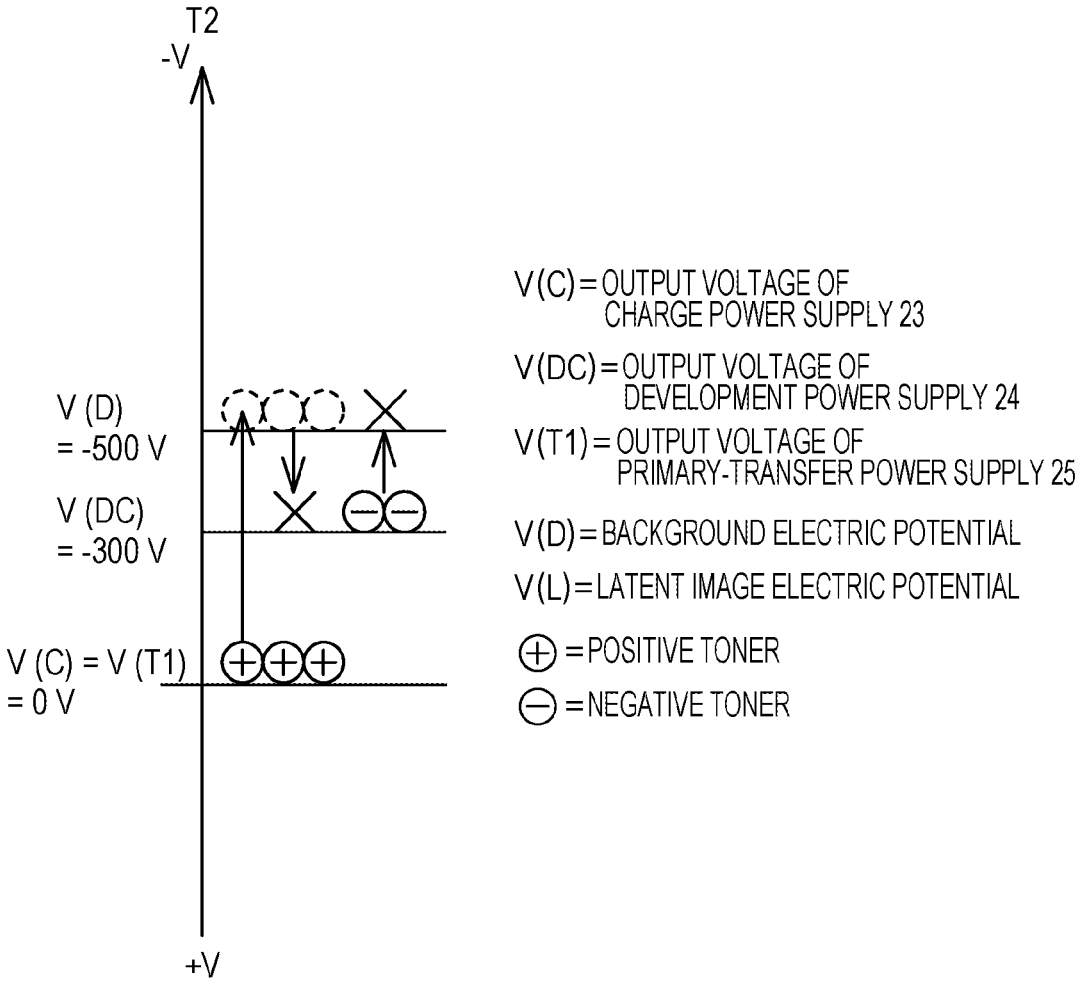
FIGS. 5A to 5C schematically illustrate the relationship between electric potentials of components when the positive toner is discharged according to the first embodiment.
Figure 5B:
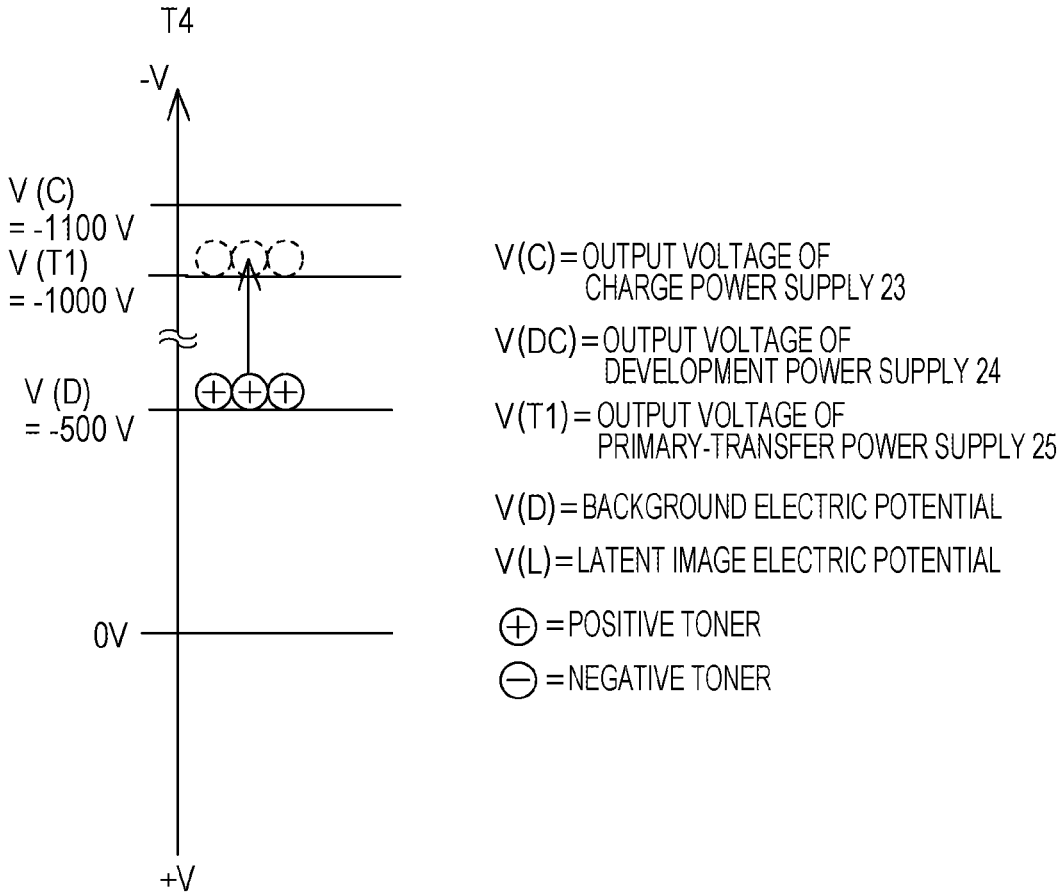
Figure 5C:
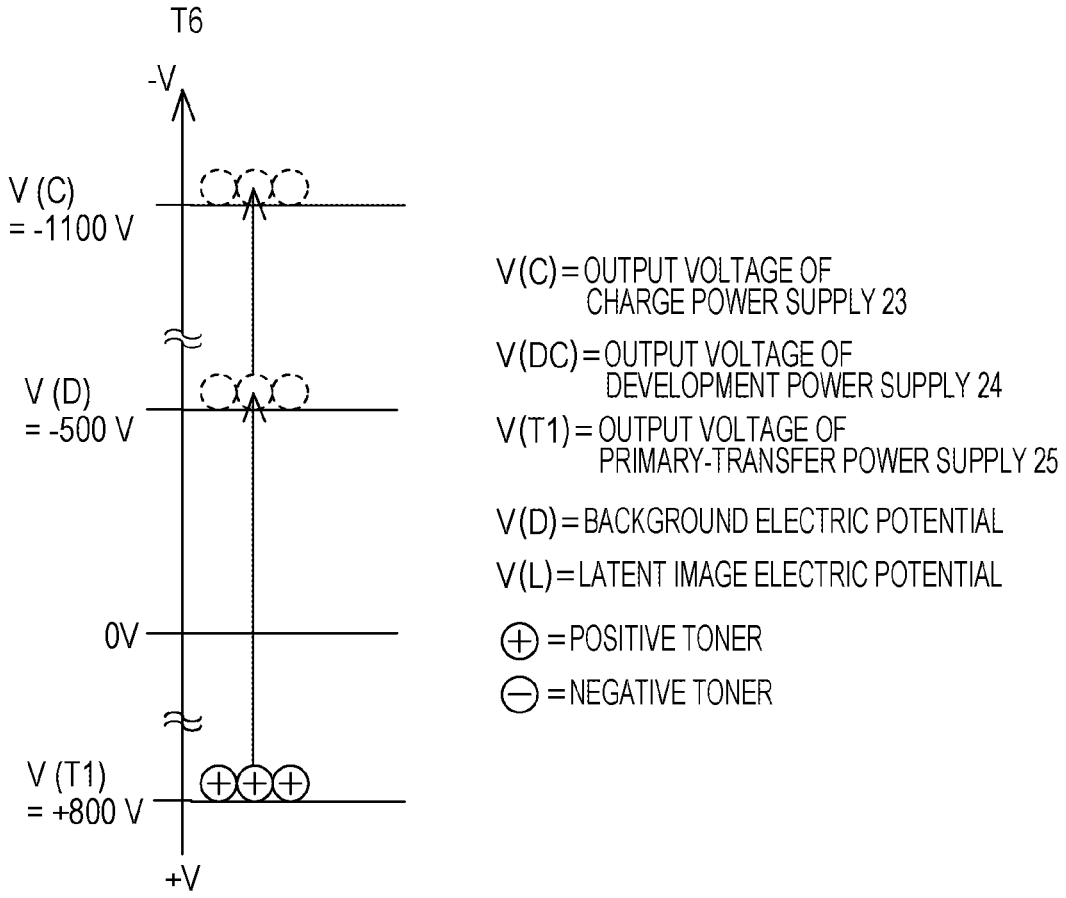
Figure 6:
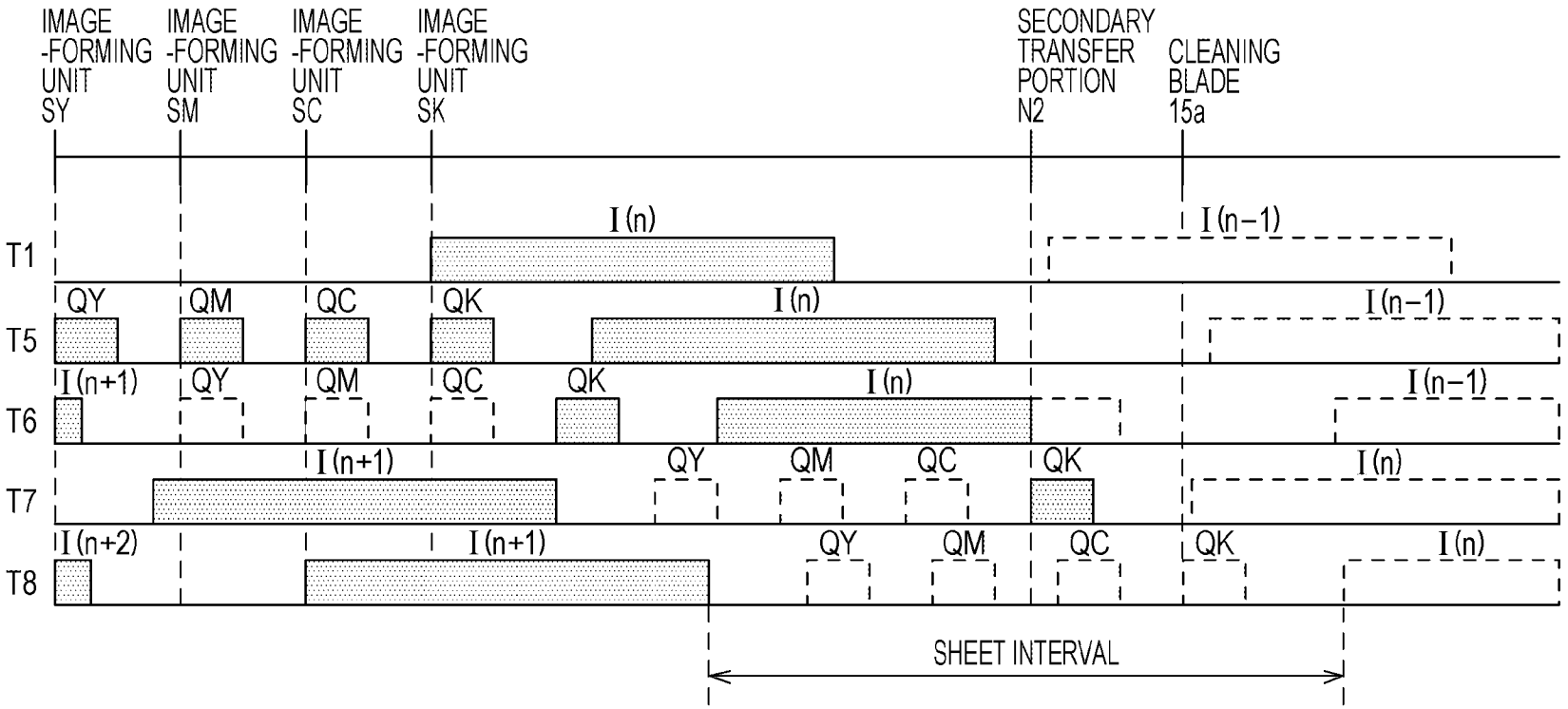
FIG. 6 schematically illustrates the position of the positive toner discharged to an intermediate transfer belt according to the first embodiment.

FIG. 4 is a timing chart of discharge of the positive toner Q according to the present embodiment. FIGS. 5A to 5C schematically illustrate the relationship between electric potentials of components when the positive toner Q is discharged according to the present embodiment. FIG. 6 schematically illustrates the position of the positive toner Q discharged to the intermediate transfer belt 8 from each photosensitive drum 1 when the positive toner Q is discharged according to the present embodiment.

As illustrated in FIG. 6, time T1 is time at which a toner image corresponding to an image I (n) to be formed on the n-th transfer material P has been primary-transferred. As illustrated in FIG. 4, at the time T1, the voltage applied from the primary-transfer power supply 25 to each primary-transfer roller 7 is changed into 0 [V] in a state where a voltage of −1100 [V] is still applied to each charge roller 3 as in during the image formation. At this time, the surface of each photosensitive drum 1 is charged by the corresponding charge roller 3 and a background electric potential of −500 [V] is uniformly formed at the surface. The electric potential difference at each primary transfer portion N1 does not exceed an electric discharge threshold because the voltage applied to each primary-transfer roller 7 is changed into 0 [V]. Each photosensitive drum 1 is not subjected to an electric discharge while rotating, and the background electric potential is maintained at −500 [V] and reaches the charging portion.

Time T2 is time at which each photosensitive drum 1 completes a rotation after time T1. At the time T2, the control circuit 22 controls the charge power supply 23 such that application of the voltage to each charge roller 3 is stopped. As illustrated in FIG. 5A, at the time T2, the relationship between the electric potentials at the charging portion at which each charge roller 3 and the corresponding photosensitive drum 1 are in contact with each other is that the electric potential of the charge roller 3 is 0 [V], and the background electric potential of the photosensitive drum 1 is −500 [V]. That is, the direction of the electric field at the charging portion at this time is opposite to the direction of the electric field formed during the image formation. The positive toner Q that attaches to each charge roller 3 is discharged from the charge roller 3 and moves to the corresponding photosensitive drum 1. According to the present embodiment, the application of the voltage from the charge power supply 23 to each charge roller 3 is stopped, and the electric potential of the charge roller 3 changed into 0 [V]. The present disclosure, however, is not limited thereto, provided that the electric potential is formed at each charge roller 3 such that the direction of the electric field at the charging portion coincides with the direction of the electric field that enables the positive toner Q to be discharged from the charge roller 3.

Subsequently, the positive toner Q that has moved from each charge roller 3 to the corresponding photosensitive drum 1 reaches the position at which the corresponding development roller 6 and the photosensitive drum 1 are in contact with each other as a result of the rotation of the photosensitive drum 1. At this time, as illustrated in FIG. 4, the development power supply 24 applies a voltage of −300 [V] to each development roller 6 as in during the image formation. That is, as illustrated in FIG. 5A, the negative toner that attaches to each development roller 6 does not attach to the corresponding photosensitive drum 1 for the reason of the relationship between the electric potential formed at the development roller 6 and the background electric potential of the photosensitive drum 1. The positive toner Q discharged from each charge roller 3 is not collected by the corresponding development roller 6. Consequently, the positive toner Q passes through the position at which each development roller 6 and the corresponding photosensitive drum 1 are in contact with each other as a result of the rotation of the photosensitive drum 1.

According to the present embodiment, each development roller 6 is not separated from the corresponding photosensitive drum 1 when the positive toner Q passes through the position at which the development roller 6 and the photosensitive drum 1 are in contact with each other. The present disclosure, however, is not limited thereto. Each development roller 6 may be separated from the corresponding photosensitive drum 1 before the positive toner Q reaches the position at which the development roller 6 and the photosensitive drum 1 are in contact with each other.

Time T3 is time at which each charge roller 3 completes a rotation after time T2. As illustrated in FIG. 4, at the time T3, the voltage applied to each charge roller 3 is changed into −1100 [V], and the discharge of the positive toner Q from the charge roller 3 is finished.

Time T4 is time at which an end of the positive toner Q discharged from each charge roller 3 at the time T2 has reached the corresponding primary transfer portion N1. As illustrated in FIG. 4, at the time T4, the control circuit 22 controls the primary-transfer power supply 25 such that the voltage applied to each primary-transfer roller 7 is changed into −1000 [V]. As illustrated in FIG. 5B, at the time T4, the relationship between the electric potentials at each primary transfer portion N1 is that the background electric potential of each photosensitive drum 1 is −500 [V], and the electric potential of each primary-transfer roller 7 is −1000 [V]. That is, at this time, the positive toner Q is transferred from each photosensitive drum 1 to the intermediate transfer belt 8 at the corresponding primary transfer portion N1.

As illustrated in FIG. 6, time T5 is time at which the trailing end of the positive toner Q has been primarily-transferred to the intermediate transfer belt 8. As illustrated in FIG. 4, at the time T5, the control circuit 22 controls the primary-transfer power supply 25 such that the voltage applied to the primary-transfer roller 7 is changed into +800 [F].

During the period from the time T1 to the time T5, the positive toner Q is discharged from each charge roller 3 to the corresponding photosensitive drum 1 and transferred from the photosensitive drum 1 to the intermediate transfer belt 8 in the image-forming units SY, SM, SC, and SK at the same time. Accordingly, as illustrated in FIG. 6, positive toners QY, QM, QC, and QK have been transferred to the intermediate transfer belt 8 by the time T5.

Time T6 is time at which the positive toners QY, QM, and QC primarily-transferred from the image-forming units other than the most downstream image-forming unit SK have passed through the downstream primary transfer portions N1M, N1C, and N1K, respectively. At this time, the n-th image I (n) reaches the secondary transfer portion N2 and is secondary-transferred to the transfer material P. As illustrated in FIG. 5C, at the time T6, the relationship between the electric potentials at each primary transfer portion N1 and the charging portion is that the electric potential of each charge roller 3 is −1100 [V], the background electric potential of each photosensitive drum 1 is −500 [V], and the electric potential of each primary-transfer roller 7 is +800 [V].

That is, as illustrated in FIG. 4, at the time T6, the electric potentials in each image-forming unit S return to the electric potentials at the time of the image formation, and the electric field for transferring the negative toner from each photosensitive drum 1 to the intermediate transfer belt 8 is formed at the corresponding primary transfer portion N1. Accordingly, as illustrated in FIG. 5C and FIG. 6, the positive toners QY, QM, and QC are respectively collected by the photosensitive drums 1M, 1C, and 1K from the intermediate transfer belt 8 while passing through the primary transfer portions N1M, N1C, and N1K, and subsequently, attach to the charge rollers 3M, 3C, and 3K. The positive toner QK transferred from the photosensitive drum 1K of the most downstream image-forming unit SK to the intermediate transfer belt 8 is conveyed by the intermediate transfer belt 8 behind the n-th image I (n). At the time T6, since the electric potentials in each image-forming unit S return to the electric potentials at the time of the image formation, the formation of a (n+1)-th image I (n+1), which is an image to be subsequently formed after the image I (n), is started.

Time T7 is time at which the positive toner QK has passed through the secondary transfer portion N2. At the time T7, the electric potential of the secondary transfer portion N2 is the same electric potential as in during the image formation. That is, the electric field for moving the negative toner from the intermediate transfer belt 8 toward the secondary-transfer roller 12 is formed at the secondary transfer portion N2. Accordingly, the positive toner QK passes through the secondary transfer portion N2 while being borne by the intermediate transfer belt 8.

Time T8 is time at which the positive toner QK has passed through the position at which the cleaning blade 15*a* and the intermediate transfer belt 8 are in contact with each other. The positive toner QK that has passed through the secondary transfer portion N2 is collected from the intermediate transfer belt 8 into the cleaning unit 15 by the cleaning blade 15*a*. According to the present embodiment, the positive toner Q is discharged from each charge roller 3 through the above operation.

First Comparative Example

Figure 7:
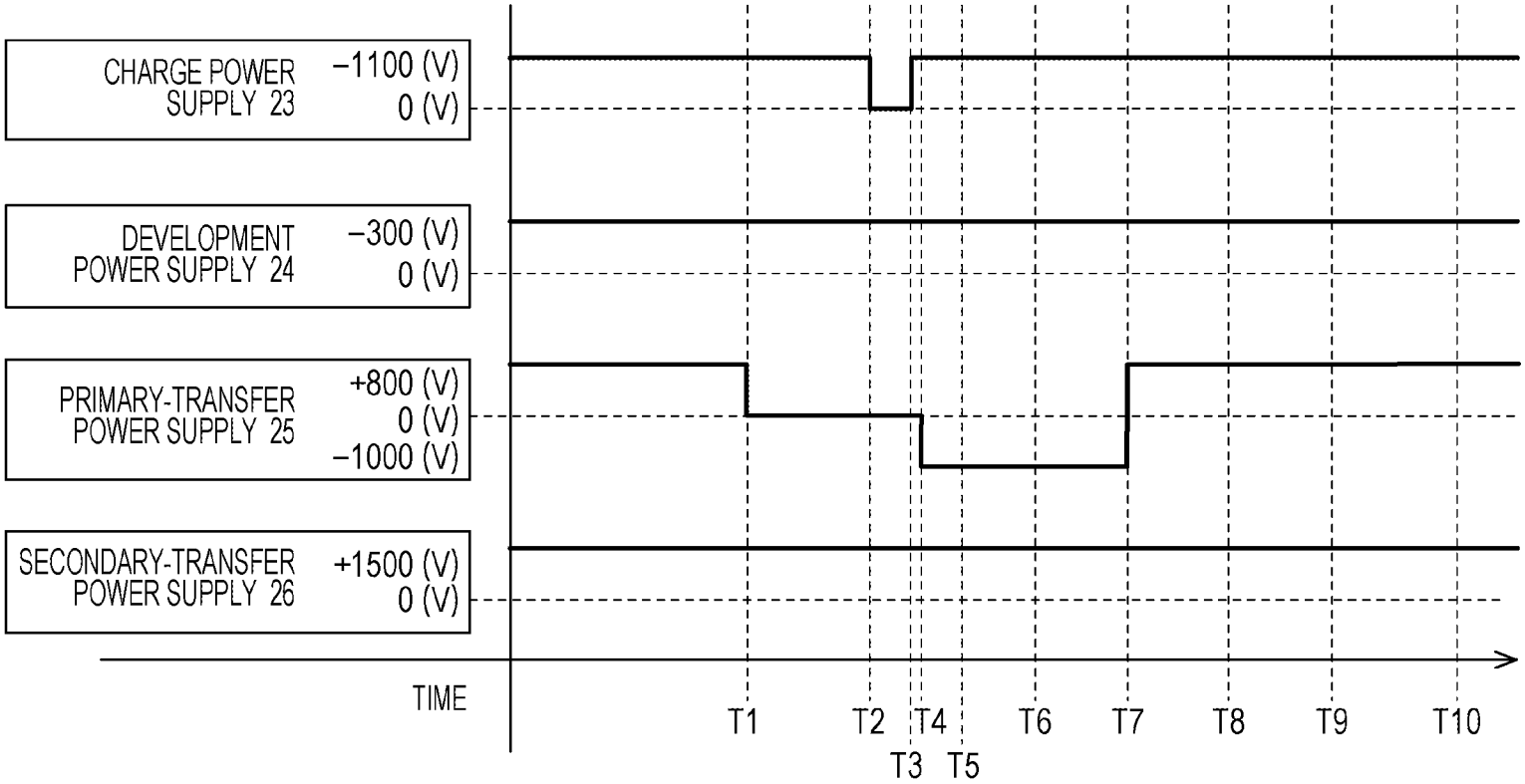
FIG. 7 is a timing chart of discharge of the positive toner in a first comparative example.
Figure 8:
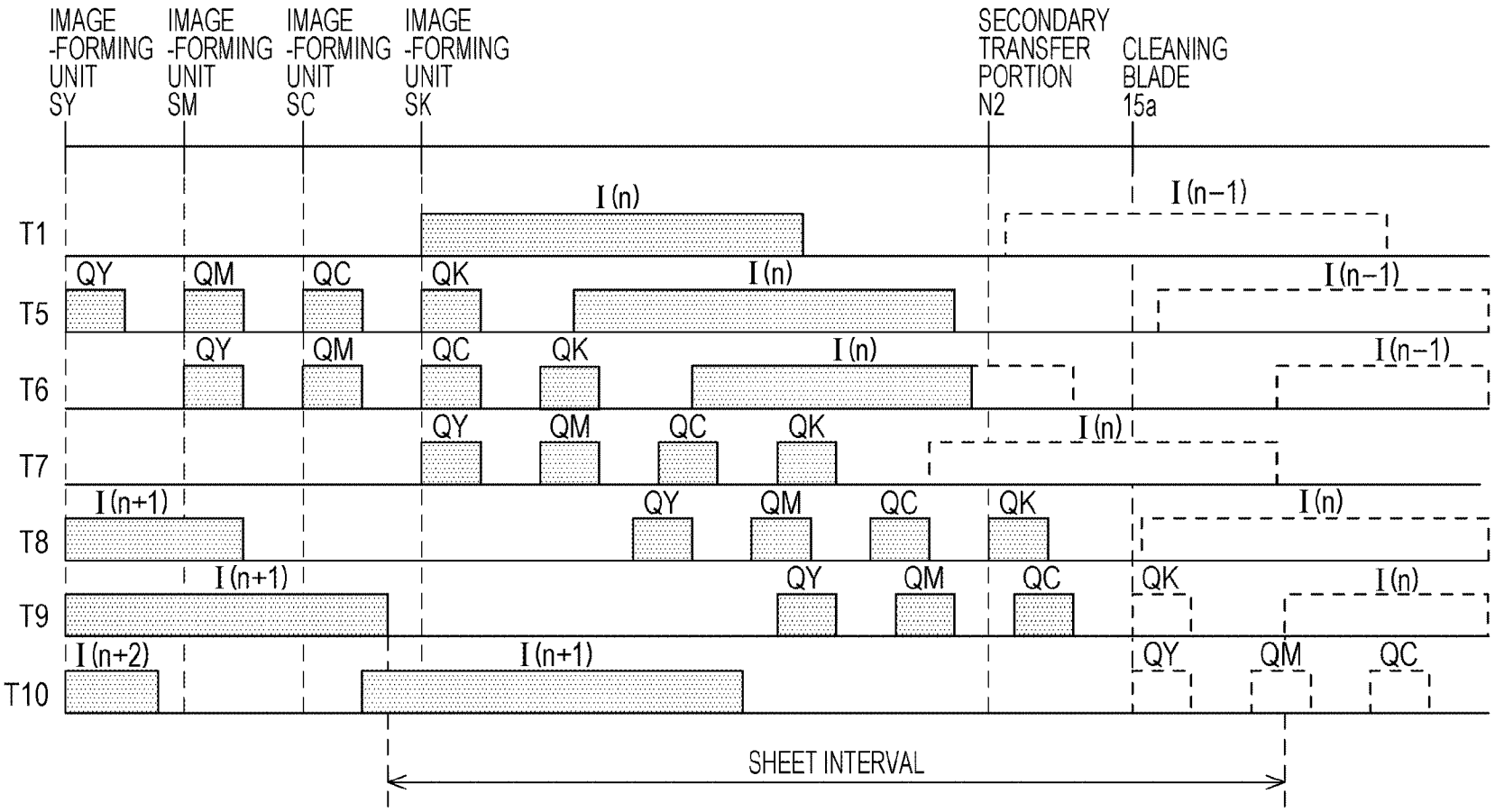
FIG. 8 schematically illustrates the position of the positive toner discharged to the intermediate transfer belt in the first comparative example.

A first comparative example against the present embodiment will now be described with reference to FIG. 7 and FIG. 8. FIG. 7 is a timing chart of discharge of the positive toner Q in the first comparative example. FIG. 8 schematically illustrates the position of the positive toner Q discharged to the intermediate transfer belt 8 from each photosensitive drum 1 when the positive toner Q is discharged in the first comparative example.

According to the present embodiment, the positive toners QY, QM, and QC among the positive toner Q discharged from each charge roller 3 are respectively collected by the downstream image-forming units SM, SC, and SK, and the positive toner QK is collected by the cleaning unit 15. The first comparative example differs from the present embodiment in that all of the positive toners QY, QM, QC, and QK transferred to the intermediate transfer belt 8 after being discharged from each charge roller 3 are collected by the cleaning unit 15. In the first comparative example, operation up to time T5 is the same as in the present embodiment. The same operation as in the present embodiment is omitted in the description, and operation after the time T5 will be described.

The time T5 is time at which the positive toner Q discharged from each charge roller 3 to the corresponding photosensitive drum 1 has been transferred from the photosensitive drum 1 to the intermediate transfer belt 8 at the corresponding primary transfer portion N1. According to the present embodiment, at the time T5, the voltage applied from the primary-transfer power supply 25 to each primary-transfer roller 7 is changed from −100 [V] into +800 [V]. In the first comparative example, however, the voltage applied from the primary-transfer power supply 25 to each primary-transfer roller 7 is maintained at −1000 [V]. Consequently, the electric field for transferring the positive toner Q from each photosensitive drum 1 to the intermediate transfer belt 8 at the primary transfer portion N1 is maintained.

Time T6 is time at which the positive toners QY, QM, and QC primarily-transferred to the intermediate transfer belt 8 from the image-forming units other than the most downstream image-forming unit SK have passed through the downstream primary transfer portions N1M, N1C, and N1K, respectively. At this time, the n-th image I (n) reaches the secondary transfer portion N2 and is secondary-transferred to the transfer material P. As illustrated in FIG. 7, an electric field is formed at the primary transfer portion N1 so as to cause the positive toner Q to move from each photosensitive drum 1 to the intermediate transfer belt 8. Consequently, as illustrated in FIG. 8, the positive toners QY, QM, and QC pass through the primary transfer portions N1M, N1C, and N1K while being borne by the intermediate transfer belt 8 at the time T6.

Time T7 is time at which the positive toner QY discharged from the charge roller 3Y of the most upstream image-forming unit SY and subsequently transferred to intermediate transfer belt 8 has passed through the most downstream primary transfer portion N1K. In the first comparative example, the voltage applied from the primary-transfer power supply 25 to each primary-transfer roller 7 changed from −1000 [V] into +800 [V] at this time. This equalizes the electric potentials in each image-forming unit S after the time T7 with the electric potentials at the time of the image forming, and the electric field for transferring the negative toner from each photosensitive drum 1 to the intermediate transfer belt 8 is formed at the corresponding primary transfer portion N1. After the time T7, the electric potentials in each image-forming unit S return to the electric potentials at the time of the image formation, and the formation of the (n+1)-th image I (n+1) is started.

Time T8 is time at which the positive toner QK has passed through the secondary transfer portion N2. At this time, the electric potential of the secondary transfer portion N2 is the same electric potential as in during the image formation, and the positive toner QK passes through the secondary transfer portion N2 while being borne by the intermediate transfer belt 8. Subsequently, the positive toners QY, QM, and QC pass through the secondary transfer portion N2 while being borne by the intermediate transfer belt 8 as in the positive toner QK.

Time T9 is time at which the positive toner QK discharged from the most downstream charge roller 3K has passed through the position at which the cleaning blade 15*a* and the intermediate transfer belt 8 are in contact with each other. The positive toner QK that has passed through the secondary transfer portion N2 is collected from the intermediate transfer belt 8 into the cleaning unit 15 by the cleaning blade 15*a*. Subsequently, the positive toners QY, QM, and QC are collected from the intermediate transfer belt 8 into the cleaning unit 15 by the cleaning blade 15*a* as in the positive toner QK.

Time T10 is time at which the positive toner QY discharged from the charge roller 3Y of the most upstream image-forming unit SY and subsequently transferred to the intermediate transfer belt 8 has been collected into the cleaning unit 15 by the cleaning blade 15*a*. In the first comparative example, the positive toner Q is discharged from each charge roller 3 through the above operation.

Effect of Present Embodiment

In the first comparative example, at the time T7, the positive toner QY discharged from the charge roller 3Y of the most upstream image-forming unit SY passes through the primary transfer portion N1K of the most downstream image-forming unit SK, and at this time, the voltage applied from the primary-transfer power supply 25 to each primary-transfer roller 7 is changed into the same voltage as in during the image formation. That is, in the first comparative example, the (n+1)-th image I (n+1) can be formed after the time T7. Accordingly, the interval (sheet interval) between the n-th image I (n) and the (n+1)-th image I (n+1) is more than a predetermined length described below. The predetermined length in the first comparative example is obtained by adding the circumferential length of each charge roller 3, which is the same as the length of the discharged positive toner Q, into the distance twice as long as the distance from the most upstream primary transfer portion N1Y to the most downstream primary transfer portion N1K.

In the image forming apparatus 100, the distance from the most upstream primary transfer portion N1Y to the most downstream primary transfer portion N1K is 180 mm, and the circumferential length of each charge roller 3 is 18.8 mm. Accordingly, the predetermined length in the first comparative example is 378.8 mm and corresponds to a time of about 3.8 seconds.

According to the present embodiment, at the time T5, the positive toner Q discharged from each charge roller 3 has been transferred from the corresponding photosensitive drum 1 to the intermediate transfer belt 8, and at this time, the voltage applied from the primary-transfer power supply 25 to each primary-transfer roller 7 is changed into the same voltage as in during the image formation. That is, the (n+1)-th image I (n+1) can be formed after the time T5. Accordingly, the interval (sheet interval) between the n-th image I (n) and the (n+1)-th image I (n+1) is more than a predetermined length obtained by adding the circumferential length of each charge roller 3, which is the same as the length of the discharged positive toner Q, into the distance from the most upstream primary transfer portion N1Y to the most downstream primary transfer portion N1K. According to the present embodiment, the predetermined length is 198.8 mm and corresponds to a time of about 2.0 seconds.

Thus, according to the present embodiment, the interval between the image I (n) and the image I (n+1) can be inhibited from increasing in a manner in which the positive toners QY, QM, and QC are collected by the downstream image-forming units SM, SC, and SK, respectively. That is, when images are formed on the transfer materials P, the throughput of the image forming apparatus 100 can be inhibited from decreasing due to an increase in the sheet interval.

The amount of the positive toner Q that attaches to the charge roller 3 of each image-forming unit S increases as the image-forming unit S is nearer to the most downstream side. The charging performance of the charge roller 3 of each image-forming unit S decreases as the image-forming unit S is nearer to the most downstream side. According to the present embodiment, the positive toner QK that attaches to the charge roller 3K of the most downstream image-forming unit SK is collected by the cleaning unit 15 for the intermediate transfer belt 8 to inhibit the charging performance of the most downstream image-forming unit SK from decreasing. The charging performance of the most downstream image-forming unit SK is most likely to decrease.

The operation of discharging the positive toner Q from each charge roller 3 is performed multiple times. Thus, the positive toner Q that attaches to each charge roller 3 is moved to the downstream image-forming units S in order and can be collected by the cleaning unit 15. Such a control enables the charging performance of each charge roller 3 to be inhibited from decreasing and enables the throughput of the image forming apparatus 100 to be inhibited from decreasing during the sheet interval.

According to the present embodiment, an example of each charge member is the charge roller 3 for uniformly forming the background electric potential at the corresponding photosensitive drum 1. According the present embodiment, however, the charge member that can discharge and collect the positive toner Q is not limited thereto. For example, the charge member may be a member that is disposed downstream of the primary transfer portion N1 and upstream of the charge roller 3 in the direction in which the photosensitive drum 1 rotates, that is in contact with the photosensitive drum 1, and that is supplied with a voltage having the regular charge polarity of the toner from the power supply. Such a member enables the positive toner Q to be inhibited from attaching to the charge roller 3. Even when the positive toner attaches to the member, the control according to the present embodiment enables the same effects as in the present embodiment to be achieved.

According to the present embodiment, the positive toners QY, QM, and QC discharged from the charge rollers 3Y, 3M, and 3C of the image-forming units SY, SM, and SC are collected by the charge rollers 3M, 3C, and 3K of the image-forming units SM, SC, and SK that are adjacent to each other on the downstream side. The present disclosure, however, is not limited thereto. For example, the positive toners QY and QM discharged from the charge rollers 3Y and 3M may be respectively collected by the charge rollers 3C and 3K in a manner in which the electric potentials at each primary transfer portion N1 are returned to the electric potentials at the time of the image formation. In this case, the positive toners QC and QK discharged from the charge rollers 3C and 3K are collected by the cleaning unit 15.

According to the present embodiment, the positive toner Q is discharged from each charge roller 3 during the interval between the n-th image I (n) and the (n+1)-th image I (n+1). The present disclosure, however, is not limited thereto. The interval between the operation of discharging the positive toner Q and start of the image formation operation can be decreased in a manner in which the positive toner Q is discharged according to the present embodiment during a pre-rotation operation of the image forming apparatus 100.

Figure 17:
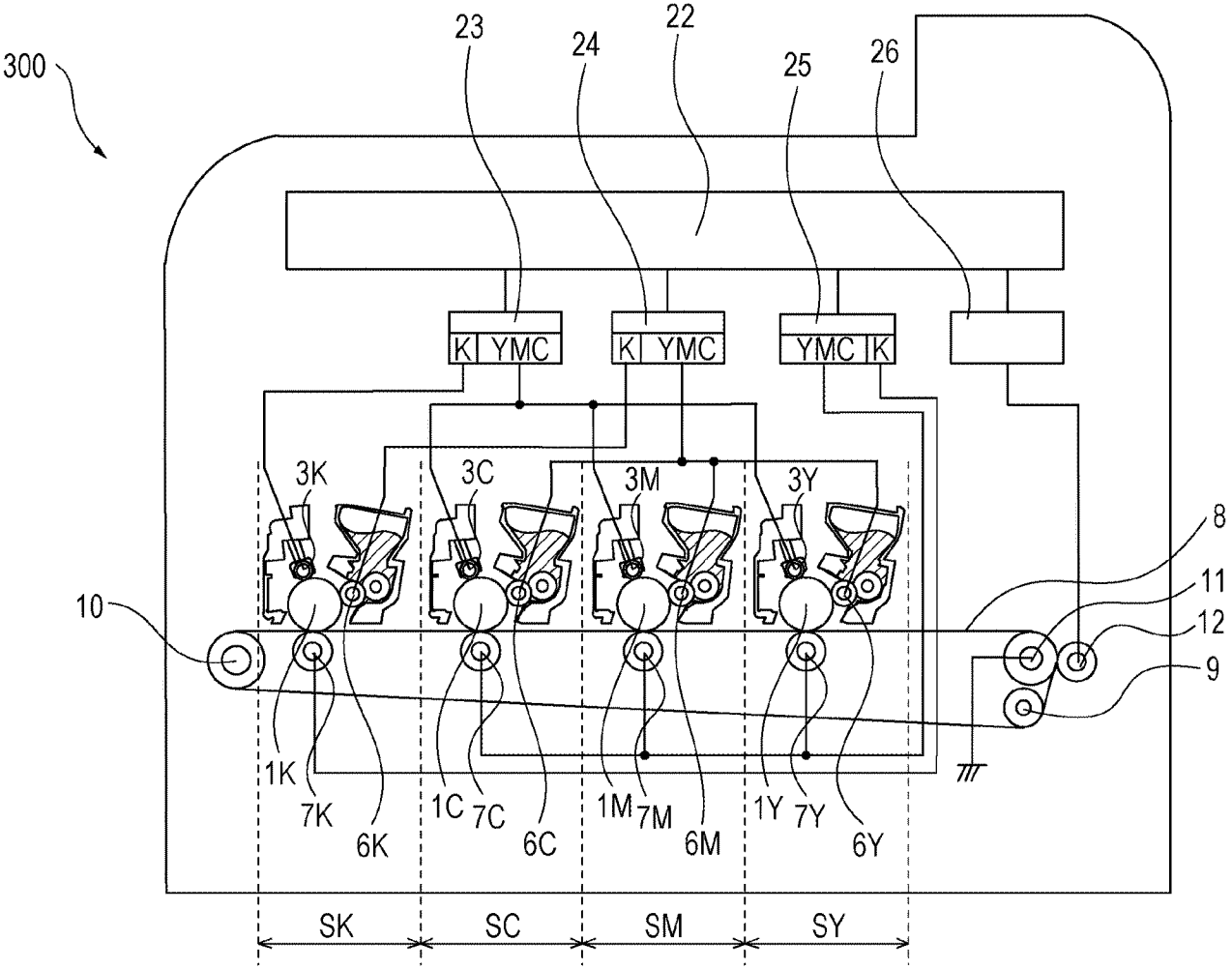
FIG. 17 schematically illustrates electric wiring of the image forming apparatus according to a modification.

In the image forming apparatus 100 according to the present embodiment, the image-forming units S share the charge power supply 23, the development power supply 24, and the primary-transfer power supply 25. The present disclosure, however, is not limited thereto. The image-forming units S may use respective charge power supplies and development power supplies that are separated from each other. Some of the image-forming units S may share the charge power supply 23, the development power supply 24, and the primary-transfer power supply 25. For example, in an image forming apparatus 300 according to a modification illustrated in FIG. 17, the image-forming units SY, SM, and SC may share the charge power supply 23, the development power supply 24, and the primary-transfer power supply 25. With such a structure, the use of a charge power supply 23K, a development power supply 24K, and a primary-transfer power supply 25K that are connected to the components of the image-forming unit SK enables a monochrome image to be formed. This reduces energy consumption.

The image forming apparatus 100 according to the present embodiment uses the intermediate transfer belt 8 but is not limited thereto. The same effects as in the present embodiment can be obtained by controlling an image forming apparatus of a direct transfer system including a conveying belt for conveying each transfer material P in the same manner as in the present embodiment.

Second Embodiment

With the structure described according to the first embodiment, the voltage is applied from the primary-transfer power supply 25 serving as the potential formation unit to the primary-transfer rollers 7Y, 7M, 7C, and 7K to form electric potentials having the same polarity at the primary transfer portions N1Y, N1M, N1C, and N1K. A second embodiment differs from the first embodiment in that a secondary-transfer power supply 26 is used as the potential formation unit that can form electric potentials having the same polarity at the primary transfer portions N1Y, N1M, N1C, and N1K. In the following description, components that are shared with the first embodiment are designated by like reference numbers, and a description thereof is omitted.

Transfer Structure

Figure 9:
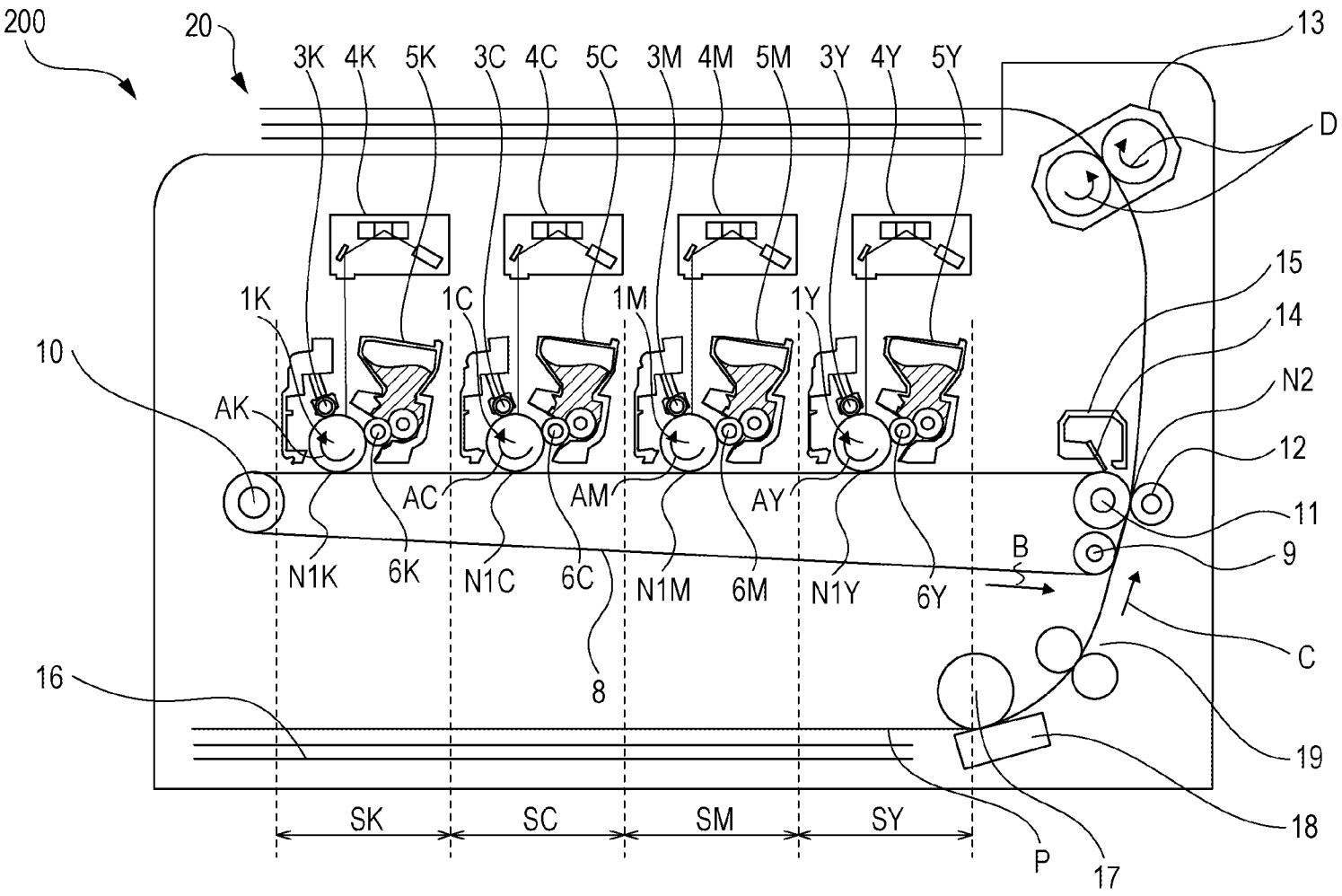
FIG. 9 is a schematic sectional view of the structure of an image forming apparatus according to a second embodiment.
Figure 10:
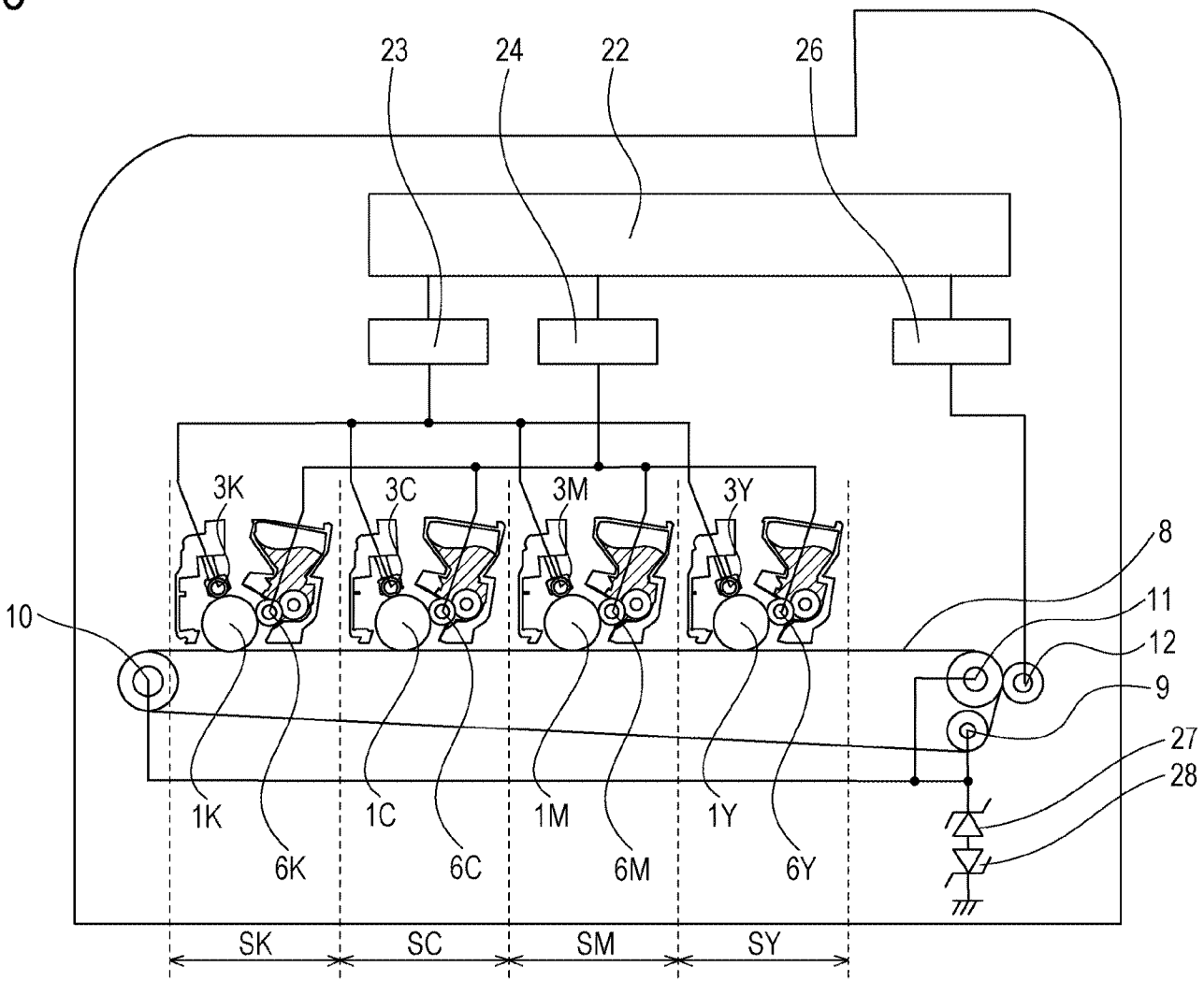
FIG. 10 schematically illustrates electric wiring of the image forming apparatus according to the second embodiment.

FIG. 9 is a schematic sectional view of the structure of an image forming apparatus 200 according to the present embodiment. FIG. 10 schematically illustrates electric wiring of the image forming apparatus 200 according to the present embodiment.

As illustrated in FIG. 9, the image forming apparatus 200 according to the present embodiment includes neither the primary-transfer roller 7 nor the primary-transfer power supply 25. The primary transfer portions N1 are formed at the positions at which the photosensitive drum 1 of each image-forming unit S and the intermediate transfer belt 8 are in contact with each other as in the first embodiment. According to the present embodiment, the intermediate transfer belt 8 is a conductive loop belt. When a voltage is applied to a part of the intermediate transfer belt 8, an electric current flows in the circumferential direction of the intermediate transfer belt According to the present embodiment, as illustrated in FIG. 10, the secondary-transfer power supply 26 serving as the potential formation unit is connected to the secondary-transfer roller 12. The secondary-transfer roller 12 is connected to the earth, and the intermediate transfer belt 8, the opposing roller 11, and a zener diode 27 and a zener diode 28 serving as voltage-maintaining elements are interposed therebetween. The drive roller 9 serving as a stretching member that stretches the intermediate transfer belt 8, the stretch roller 10, and the opposing roller 11 are connected to each other and have the same electric potential.

The zener diode 27 and the zener diode 28 serving as the voltage-maintaining elements maintain a certain voltage (referred to below as a breakdown voltage) when an electric current flows therethrough. When the intensity of the electric current flowing therethrough is a certain value or more, the breakdown voltage is applied on the cathode side. According to the present embodiment, the zener diode 27 maintains the electric potential of the intermediate transfer belt 8 at the breakdown voltage having the positive polarity, and the zener diode 27 in the positive direction and the zener diode 28 in the negative direction are connected to each other in series. That is, the cathode side of the zener diode 28 (second zener diode) is connected to the earth. The anode side of the zener diode 28 is connected on the anode side of the zener diode 27 (first zener diode). The cathode side of the zener diode 27 is connected to components (such as the drive roller 9, the stretch roller 10, and the opposing roller 11) in contact with the inner circumferential surface of the intermediate transfer belt 8. The breakdown voltage of the zener diode 27 in the positive direction is 300 [V]. The breakdown voltage of the zener diode 28 in the negative direction is −1000 [V].

When the secondary-transfer power supply 26 applies a voltage having the positive polarity that is sufficiently larger than the breakdown voltage of the zener diode 27 to the secondary-transfer roller 12, the zener diode 27 forms reverse-direction connection, and the zener diode 28 forms forward-direction connection. Consequently, an electric potential of about +300 [V] that is equal to the breakdown voltage of the zener diode 27 in the positive direction is formed at each primary transfer portion N1. When the secondary-transfer power supply 26 applies a voltage having the negative polarity that is sufficiently larger than the breakdown voltage of the zener diode 28 to the secondary-transfer roller 12, the zener diode 27 forms forward-direction connection, and the zener diode 28 forms reverse-direction connection. Consequently, an electric potential of about −1000[V] that is equal to the breakdown voltage of the zener diode 28 in the negative direction is formed at each primary transfer portion N1. According to the present embodiment, the secondary-transfer power supply 26 serving as the potential formation unit thus applies the voltage to the secondary-transfer roller 12, and consequently, the electric potentials having the same polarity are formed at each primary transfer portion N1.

According to the present embodiment, the zener diode 27 and the zener diode 28 that are constant voltage elements are used as the voltage-maintaining elements to make the electric potential of the intermediate transfer belt 8 stable. However, varistors may be used as other constant voltage elements provided that the elements can achieve the same effects. Resistance elements are also acceptable provided that the electric potential of the intermediate transfer belt 8 can be maintained at a predetermined electric potential or more. For example, resistance elements having about 50 M Ω to 100 M Ω may be used.

Discharge of Positive Toner

Figure 11:
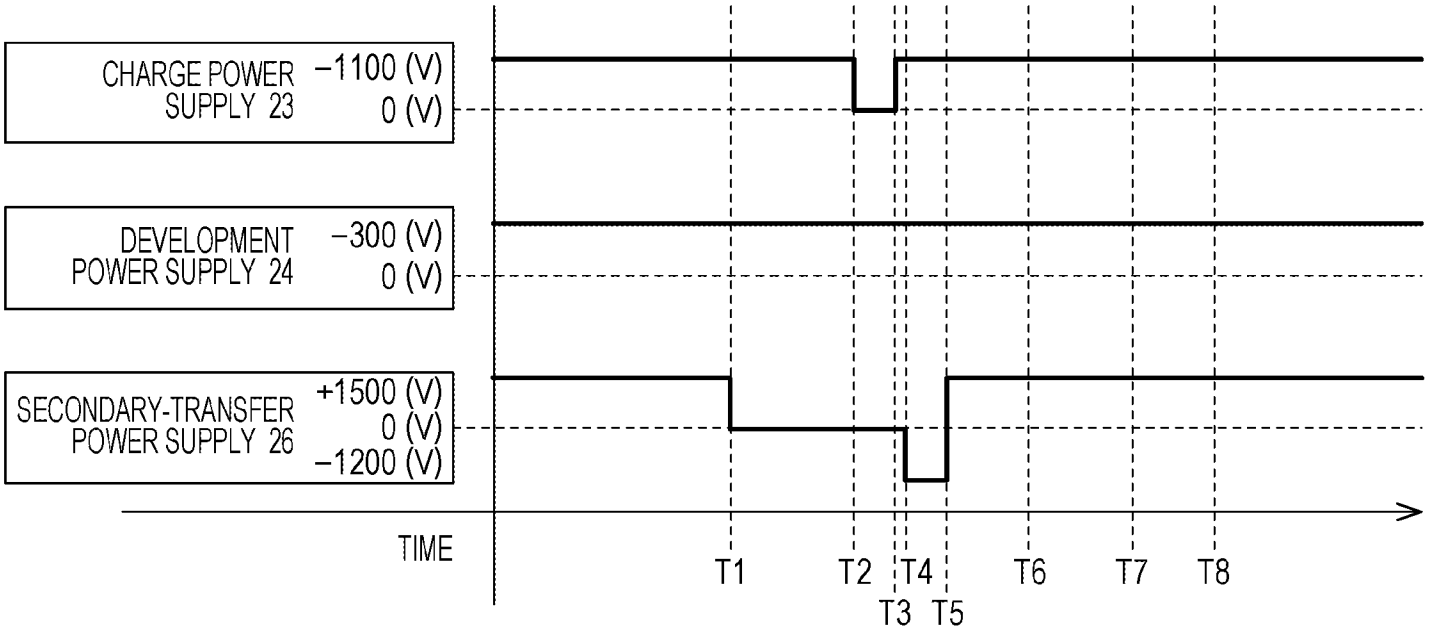
FIG. 11 is a timing chart of discharge of the positive toner according to the second embodiment.
Figure 12:
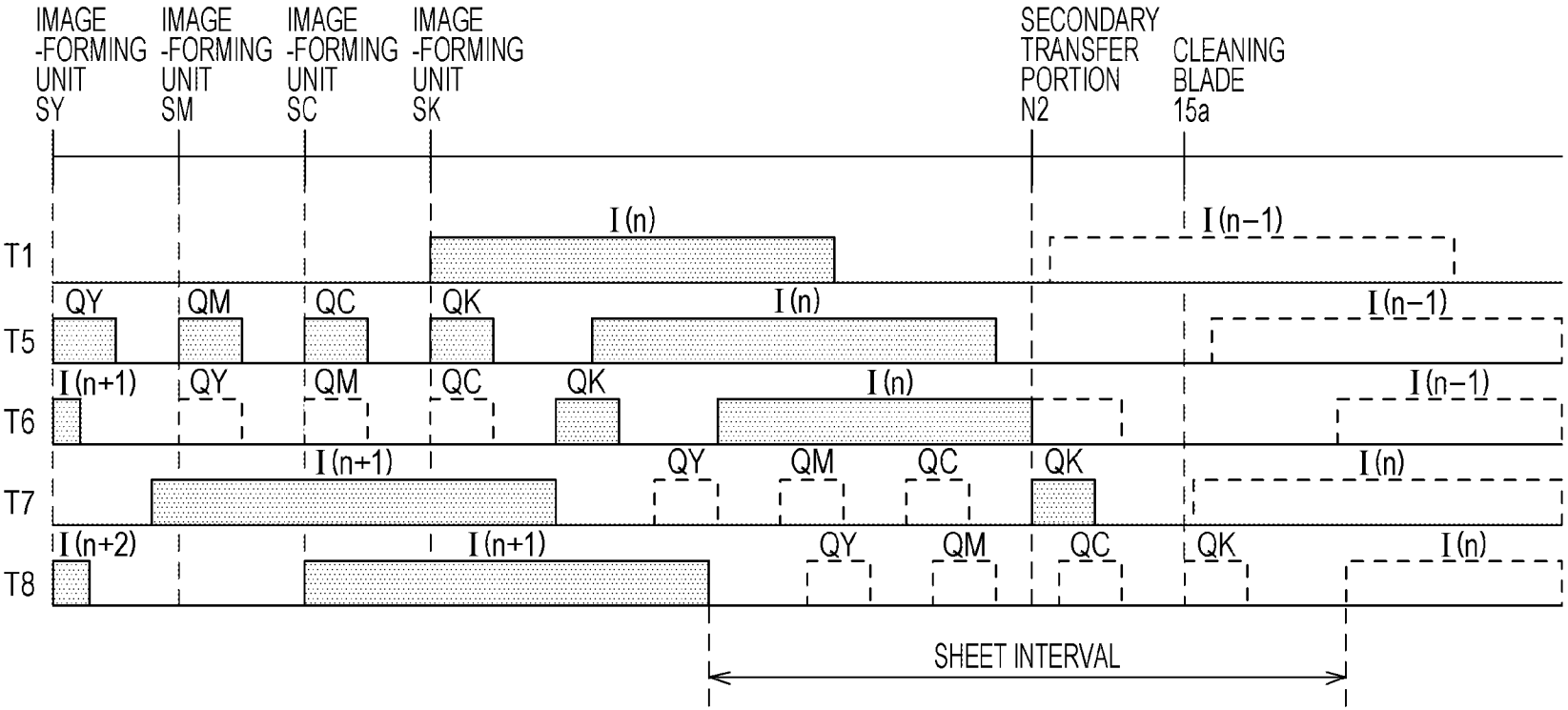
FIG. 12 schematically illustrates the position of the positive toner discharged to the intermediate transfer belt according to the second embodiment.

FIG. 11 is a timing chart of discharge of the positive toner Q according to the present embodiment. FIG. 12 schematically illustrates the position of the positive toner Q discharged from each photosensitive drum 1 to the intermediate transfer belt 8 when the positive toner Q is discharged according to the present embodiment.

According to the present embodiment, as illustrated in FIG. 12, the positive toners QY, QM, and QC among the positive toner Q discharged from each charge roller 3 are collected by the downstream image-forming units SM, SC, and SK, and the positive toner QK is collected by the cleaning unit 15 as in the first embodiment. The present embodiment differs from the first embodiment in that when the positive toner Q is discharged, the electric potential is formed at each primary transfer portion N1 by the secondary-transfer power supply 26 and not the primary-transfer power supply 25. More specifically, as illustrated in FIG. 11, at the time T1, the time T4, and the time T5, the voltage applied from the secondary-transfer power supply 26 to the secondary-transfer roller 12 differs from the voltage applied according to the first embodiment. In the following description, components that are shared with the first embodiment are omitted, and a description of differences will be described in detail.

At the time T1, the voltage applied from the secondary-transfer power supply 26 to the secondary-transfer roller 12 is changed into 0 [V] in a state where a voltage of −1100 [V] is still applied to each charge roller 3 as in during the image formation. Consequently, the electric potential formed at the intermediate transfer belt 8 becomes 0 [V]. The electric potential difference at each primary transfer portion N1 does not exceed the electric discharge threshold. Each photosensitive drum 1 is not subjected to an electric discharge while rotating, and the background electric potential is maintained at −500 [V] and reaches the charging portion.

The time T4 is time at which an end of the positive toner Q discharged from each charge roller 3 at the time T2 has reached the corresponding primary transfer portion N1. As illustrated in FIG. 11, at the time T4, the voltage applied from the secondary-transfer power supply 26 to the secondary-transfer roller 12 is changed into −1200 [V], and the electric potential of the intermediate transfer belt 8 is maintained at the breakdown voltage of the zener diode 28. Consequently, an electric potential of about −1000 [V] that is equal to the breakdown voltage of the zener diode 28 is formed at each primary transfer portion N1. The positive toner Q is transferred from each photosensitive drum 1 to the intermediate transfer belt 8.

As illustrated in FIG. 12, the time T5 is time at which the trailing end of the positive toner Q has been transferred to the intermediate transfer belt 8. As illustrated in FIG. 11, at the time T5, the voltage applied from the secondary-transfer power supply 26 to the secondary-transfer roller 12 is changed into +1500 [V] as in during the image formation. Consequently, the electric potential of the intermediate transfer belt 8 is maintained at +300 [V] that is equal to the breakdown voltage of the zener diode 27. After the time T5, the electric potentials in each image-forming unit S return to the electric potentials at the time of the image formation, and the electric field for transferring the negative toner from each photosensitive drum I to the intermediate transfer belt 8 is formed at the corresponding primary transfer portion N1.

According to the present embodiment, the positive toner is discharged from each charge roller 3 in the same manner as in the first embodiment except for the operation described above.

Second Comparative Example

Figure 13:
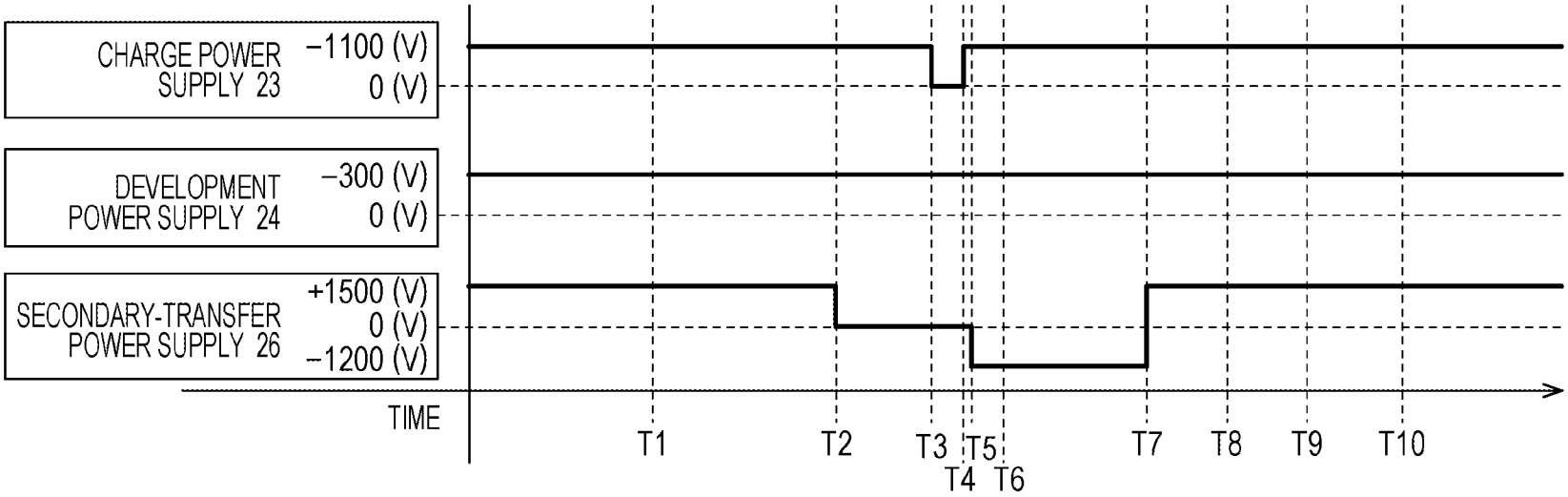
FIG. 13 is a timing chart of discharge of the positive toner in a second comparative example.
Figure 14:
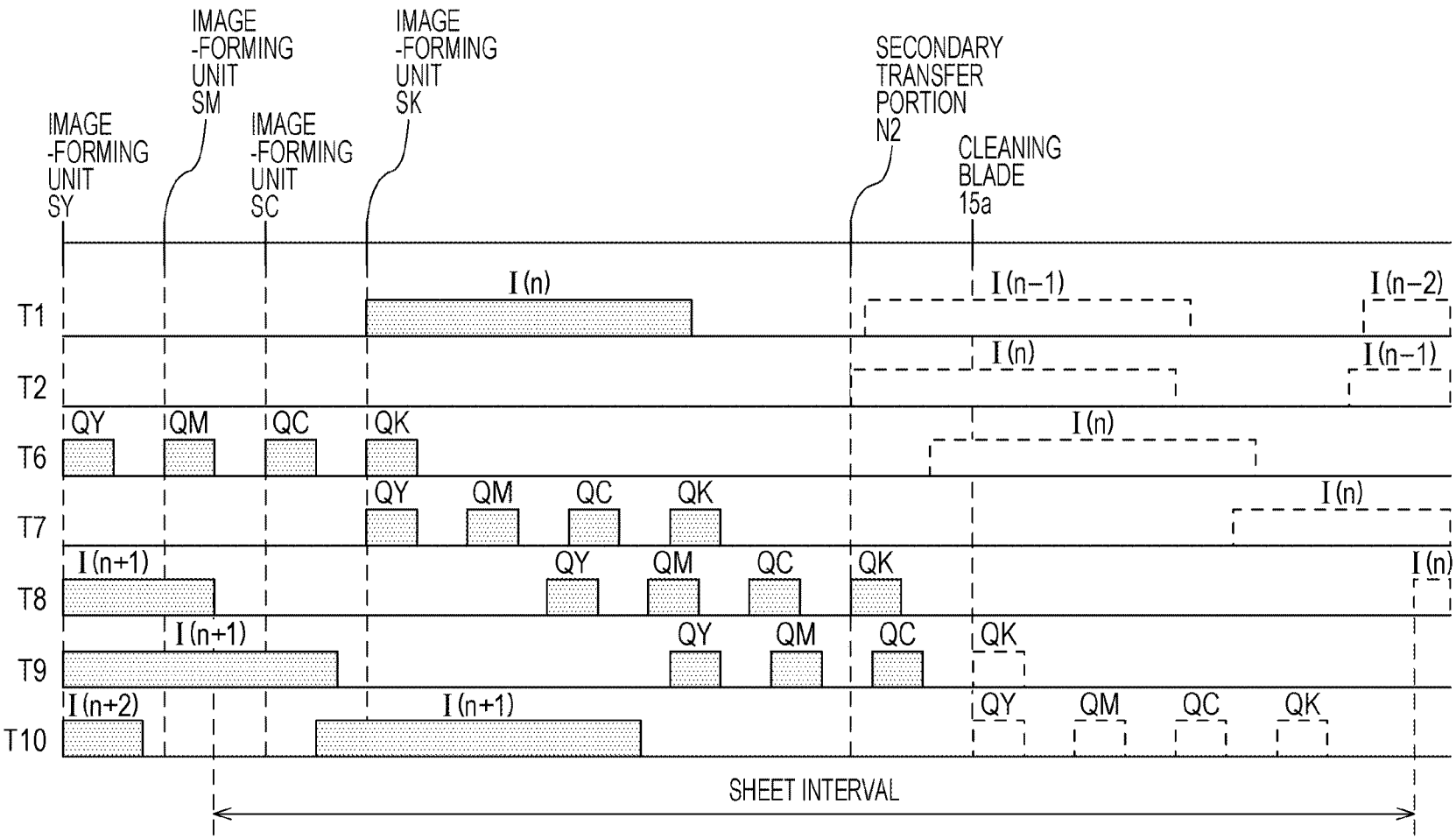
FIG. 14 schematically illustrates the position of the positive toner discharged to the intermediate transfer belt in the second comparative example.

A second comparative example will now be described with reference to FIG. 13 and FIG. 14. FIG. 13 is a timing chart of discharge of the positive toner Q in the second comparative example. FIG. 14 schematically illustrates the position of the positive toner Q discharged from each photosensitive drum 1 to the intermediate transfer belt 8 when the positive toner Q is discharged in the second comparative example.

According to the present embodiment, the positive toners QY, QM, and QC among the positive toner Q discharged from each charge roller 3 are collected by the downstream image-forming units SM, SC, and SK, and the positive toner QK is collected by the cleaning unit 15. The second comparative example differs from the present embodiment in that all of the positive toners QY, QM, QC, and QK transferred to the intermediate transfer belt 8 after being discharged from each charge roller 3 are collected by the cleaning unit 15. In the following description of the second comparative example, a description of the same components as in the present embodiment is omitted.

Time T1 is time at which the primary transfer of the n-th image I (n) is finished. According to the present embodiment, at the time T1, the operation of discharging the positive toner Q is started. In the second comparative example, however, the operation of discharging the positive toner Q cannot be started until time T2 at which the n-th image I (n) has passed through the secondary transfer portion N2. The reason is that in the image forming apparatus 200, the electric field of each primary transfer portion N1 and the electric field of the secondary transfer portion N2 cannot be individually controlled. In the case where the voltage applied from the secondary-transfer power supply 26 to the secondary-transfer roller 12 is changed to start the operation of discharging the positive toner Q before the image I (n) has passed through the secondary transfer portion N2, it is difficult to secondary-transfer the image I (n) to the transfer material P at the secondary transfer portion N2.

Accordingly, in the second comparative example, the positive toner Q is discharged from each charge roller 3 after the time T2 at which the n-th image I (n) has passed through the secondary transfer portion N2. Operation from the time T2 up to time T6 at which the positive toner Q has been transferred to the intermediate transfer belt 8 is the same as the operation from the time T1 up to time T5 according to the present embodiment, and a description thereof is omitted.

As illustrated in FIG. 14, the positive toners QY, QM, QC, and QK have been transferred to the intermediate transfer belt 8 by the time 16. In the second comparative example, the positive toner Q is collected by the cleaning unit 15, and accordingly, the electric potentials at the time 16 are maintained until time 17 at which the positive toner QY discharged from the charge roller 3Y of the most upstream image-forming unit SY has passed through the primary transfer portion N1K of the most downstream image-forming unit SK. That is, as illustrated in FIG. 13, the voltage applied from the secondary-transfer power supply 26 to the secondary-transfer roller 12 is not changed, and the electric potentials when the positive toner Q is transferred from each photosensitive drum 1 to the intermediate transfer belt 8 are maintained.

At the time T7 at which the positive toner QY subsequently has passed through the primary transfer portion N1K, the voltage applied from the secondary-transfer power supply 26 to the secondary-transfer roller 12 is changed into +1500 [V] as in during the image formation. Consequently, the electric potential of the intermediate transfer belt 8 is maintained at +300 [V] that is equal to the breakdown voltage of the zener diode 27, and the formation of the (n+1)-th image I (n+1) can be started.

Time T8 is time at which the positive toner QK has passed through the secondary transfer portion N2. At this time, the same electric potential as in during the image formation is formed at the secondary transfer portion N2, and the positive toner QK passes through the secondary transfer portion N2 while being borne by the intermediate transfer belt 8. Subsequently, the positive toners QY, QM, and QC pass through the secondary transfer portion N2 while being borne by the intermediate transfer belt 8 as in the positive toner QK.

Time T9 is time at which the positive toner QK discharged from the most downstream charge roller 3K has passed through the position at which the cleaning blade 15*a* and the intermediate transfer belt 8 are in contact with each other. The positive toner QK that has passed through the secondary transfer portion N2 is collected from the intermediate transfer belt 8 into the cleaning unit 15 by the cleaning blade 15*a*. Subsequently, the positive toners QY, QM, and QC are collected from the intermediate transfer belt 8 into the cleaning unit 15 by the cleaning blade 15*a* as in the positive toner QK.

Time T10 is time at which the positive toner QY discharged from the charge roller 3Y of the most upstream image-forming unit SY and subsequently transferred to the intermediate transfer belt 8 has been collected into the cleaning unit 15 by the cleaning blade 15*a*. In the second comparative example, the positive toner Q is discharged from each charge roller 3 through the above operation.

Effects of Present Embodiment

In the second comparative example, the operation of discharging the positive toner Q cannot be started until the time T2 at which the n-th image I (n) has been secondary-transferred to the transfer material P at the secondary transfer portion N2. In addition, the voltage applied from the secondary-transfer power supply 26 to the secondary-transfer roller 12 cannot be changed into the same voltage as in during the image formation until the time T7 at which the positive toner QY discharged from the most upstream charge roller 3Y has passed through the primary transfer portion N1K.

Accordingly, the interval (sheet interval) between the n-th image I (n) and the (n+1)-th image I (n+1) is more than a predetermined length described below. The predetermined length in the second comparative example is obtained by adding the circumferential length of each charge roller 3, which is the same as the length of the discharged positive toner Q, and the distance twice as long as the distance from the most upstream primary transfer portion N1Y to the most downstream primary transfer portion N1K into the distance from the most downstream primary transfer portion N1K to the secondary transfer portion N2.

In the image forming apparatus 200, the distance from the most downstream primary transfer portion N1K to the secondary transfer portion N2 is 400 mm, the distance from the most upstream primary transfer portion N1Y to the downstream primary transfer portion NIK is 180 mm, and the circumferential length of each charge roller 3 is 18.8 mm. Accordingly, the predetermined length in the second comparative example is 778.8 mm and corresponds to a time of about 7.8 seconds.

According to the present embodiment, the voltage applied from the secondary-transfer power supply 26 to the secondary-transfer roller 12 can be changed into the same voltage as in during the image formation at the time T5 at which the positive toner Q has been transferred from each photosensitive drum 1 to the intermediate transfer belt 8. That is, the (n+1)-th image I (n+1) can be formed after the time T5. Accordingly, the interval (sheet interval) between the n-th image I (n) and the (n+1)-th image I (n+1) is more than a predetermined length obtained by adding the circumferential length of each charge roller 3, which is the same as the length of the discharged positive toner Q, into the distance from the most upstream primary transfer portion N1Y to the most downstream primary transfer portion N1K. According to the present embodiment, the predetermined length is 198.8 mm and corresponds to a time of about 2.0 seconds.

Thus, the image forming apparatus 200 according to the present embodiment also enables the interval between the image I (n) and the image I (n+1) to be inhibited from increasing in a manner in which the positive toners QY, QM, and QC are collected by the downstream image-forming units SM, SC, and SK, respectively. That is, when images are formed on the transfer materials P, the throughput of the image forming apparatus 200 can be inhibited from decreasing due to an increase in the sheet interval as in the first embodiment.

Third Embodiment

According to the first embodiment, the positive toner Q is discharged during the interval (sheet interval) between the color image I (n) and the color image I (n+1) that are continuously formed. The third embodiment differs from the first embodiment in that the positive toner Q is discharged during the interval (sheet interval) between a color image I (n) and a monochrome image I (n+1). In the following description, components that are shared with the first embodiment are designated by like reference numbers, and a description thereof is omitted.

Discharge of Positive Toner

Figure 15:
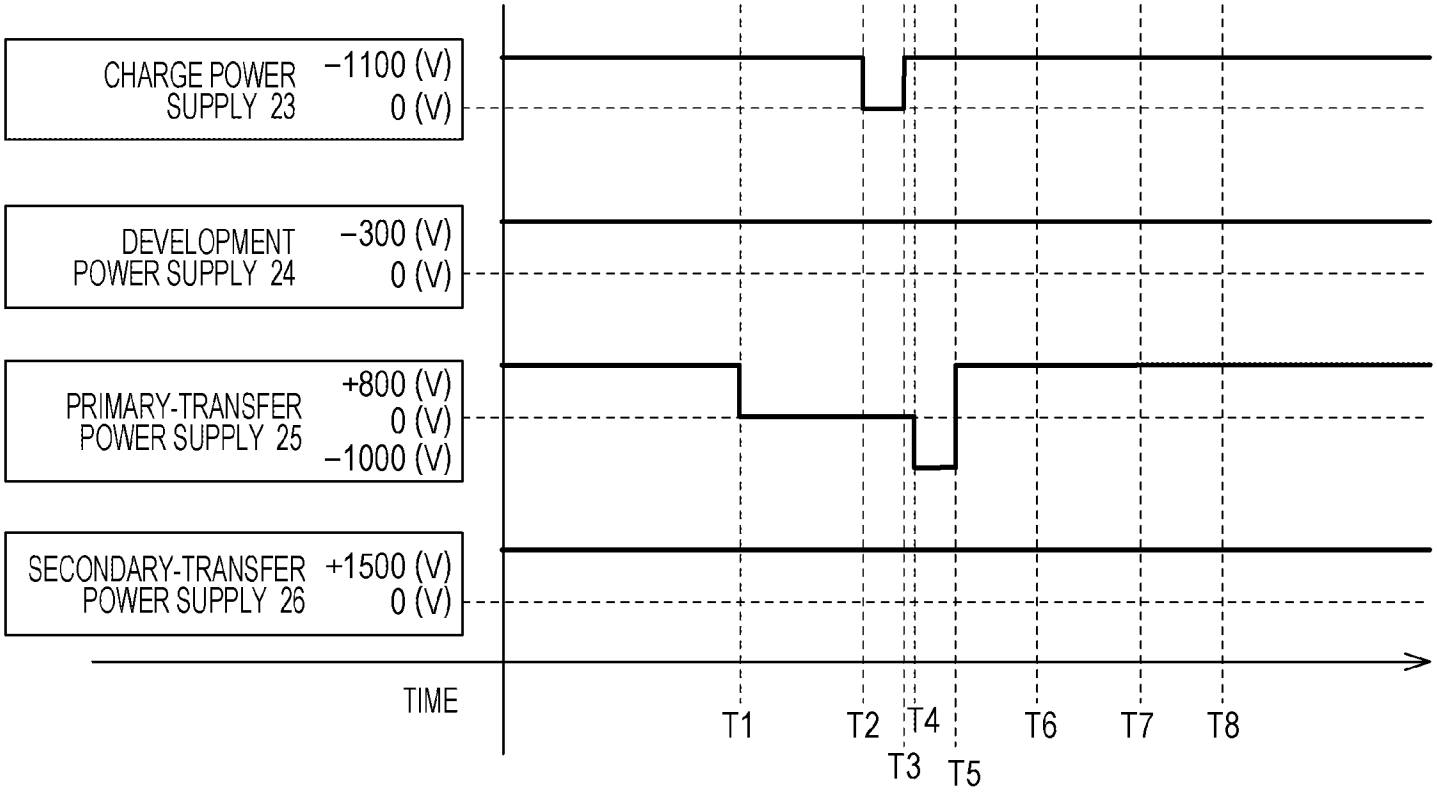
FIG. 15 is a timing chart of discharge of the positive toner in a third embodiment.
Figure 16:
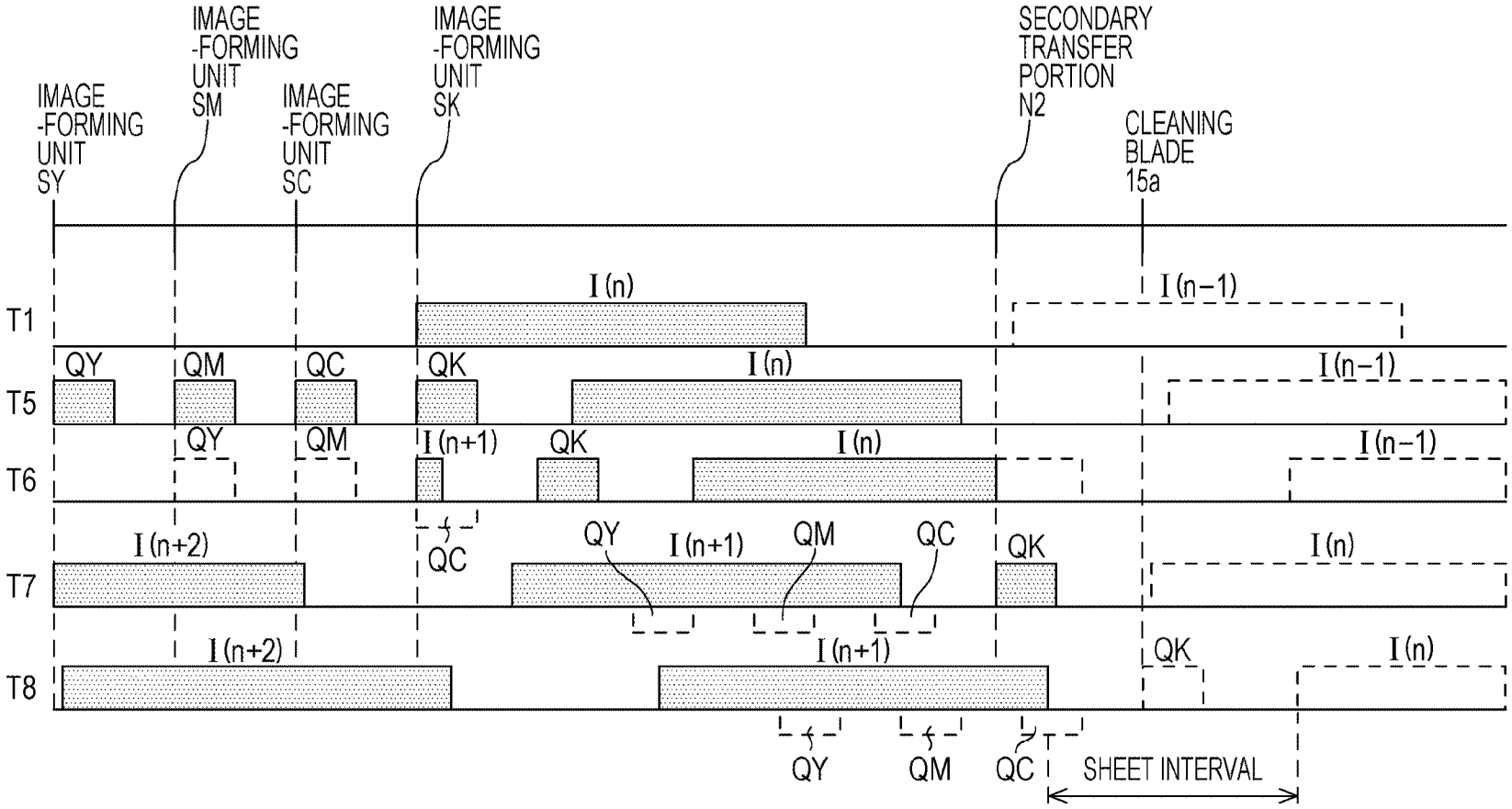
FIG. 16 schematically illustrates the position of the positive toner discharged to the intermediate transfer belt according to the third embodiment.

FIG. 15 is a timing chart of discharge of the positive toner Q according to the present embodiment. FIG. 16 schematically illustrates the position of the positive toner Q discharged from each photosensitive drum 1 to the intermediate transfer belt 8 when the positive toner Q is discharged according to the present embodiment.

In FIG. 16, the n-th image I (n) is a color image, and the (n+1)-th image I (n+1) is a monochrome image. According to the present embodiment, a (n+2)-th image I (n+2) is a color image but can be a monochrome image. According to the present embodiment, operation up to time T5 is the same as in the first embodiment, a description thereof from time T1 up to the time T5 is omitted, and operation after the time T5 will be described in detail.

The time T5 is time at which the positive toner Q discharged from each charge roller 3 to the corresponding photosensitive drum 1 has been transferred from the photosensitive drum 1 to the intermediate transfer belt 8 at the corresponding primary transfer portion N1. At this time, the electric potentials in each image-forming unit S return to the electric potentials at the time of the image formation. At the time T5, the image-forming unit SK starts the formation of the (n+1)-th image I (n+1).

Time T6 is time at which the positive toners QY, QM, and QC transferred from the image-forming units other than the most downstream image-forming unit SK have passed through the downstream primary transfer portions N1M, N1C, and N1K, respectively. As illustrated in FIG. 16, the positive toners QY, QM, and QC are respectively collected from the intermediate transfer belt 8 by the photosensitive drums 1M, 1C, and 1K while passing through the primary transfer portions N1M, N1C, and N1K, and subsequently, attach to the charge rollers 3M, 3C, and 3K. At this time, in the image-forming unit SK, the image I (n+1) is primary-transferred from each photosensitive drum 1 to the intermediate transfer belt 8, and at the same time, the positive toner QC is collected from the intermediate transfer belt 8 into the photosensitive drum 1K.

Operation after the time T6 is the same as in the first embodiment. At time T7, the positive toner QK passes through the secondary transfer portion N2. At time T8, the positive toner QK is collected by the cleaning unit 15.

Effects of Present Embodiment

The positive toner Q is thus discharged according to the present embodiment during the interval (sheet interval) between the color image I (n) and the monochrome image I (n+1) that are continuously formed, and this enables the sheet interval to be shorter than that in the first embodiment.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-093326 filed May 9, 2017, which is hereby incorporated by reference herein in its entirety.

What is claimed is:

1. An image forming apparatus comprising:

a first image-bearing member that bears a toner image;

a movable belt that is in contact with the first image-bearing member and that forms a first transfer portion;

a first charge member that is in contact with the first image-bearing member and that charges the first image-bearing member;

a first developing unit that develops an electrostatic latent image formed on the first image-bearing member to form the toner image by using a toner and that is able to collect at least a charged toner having a first polarity that is a regular charge polarity of the toner among residual toners on the first image-bearing member after the toner passes through the first transfer portion as a result of rotation of the first image-bearing member;

a second image-bearing member that is disposed downstream of the first image-bearing member in a direction in which the belt moves, and in contact with the movable belt to form a second transfer portion;

a second charge member that is in contact with the second image-bearing member and that charges the second image-bearing member;

a second developing unit that develops an electrostatic latent image formed on the second image-bearing member to form a toner image by using a toner and that is able to collect at least a charged toner having the first polarity among residual toners on the second image-bearing member after the toner passes through the second transfer portion as a result of rotation of the second image-bearing member;

a common potential formation unit that forms a first electric field or a second electric field at the first transfer portion and the second transfer portion, wherein the first electric field is an electric field acting in a direction of transferring a toner having a second polarity, which is opposite of the first polarity, from the first image-bearing member and the second image-bearing member toward the belt, and wherein the second electric field is an electric field acting in a direction of transferring the toner having the first polarity from the first image-bearing member and the second image-bearing member toward the belt; and a control unit that controls the first charge member, the second charge member, and the potential formation unit, wherein the control unit controls the first charge member to move a charged first toner, that has the second polarity and that attaches to the first charge member, from the first charge member to the first image-bearing member, and controls the potential formation unit to form the first electric field, at the first transfer portion and the second transfer portion, to transfer the first toner from the first image-bearing member to the belt, and wherein the control unit controls the potential formation unit to form the second electric field before the first toner that has been transferred to the belt reaches the second transfer portion, at the first transfer portion and the second transfer portion, to move the first toner from the belt to the second image-bearing member at the second transfer portion, and controls the second charge member to collect the first toner which has been moved to the second image-bearing member.

2. The image forming apparatus according to claim 1 further comprising:

a charge power supply that applies a voltage to the first charge member and the second charge member, wherein the control unit controls the charge power supply to charge the first image-bearing member and the second image-bearing member by applying such that a voltage having the first polarity to the first charge member and the second charge member.

3. The image forming apparatus according to claim 2, wherein when the control unit controls the charge power supply to stop the application of the voltage having the first polarity to the first charge member, the first toner that attaches to the first charge member is moved to the first image-bearing member.

4. The image forming apparatus according to claim 3, wherein the first developing unit develops the electrostatic latent image formed on the first image-bearing member with the first developing unit in contact with the first image-bearing member, and wherein the control unit causes the first developing unit to separate from the first image-bearing member before the application of the voltage having the first polarity to the first charge member from the charge power supply is stopped.

5. The image forming apparatus according to claim 2, wherein the first toner moved to the second image-bearing member is collected by the second charge member by applying the voltage having the first polarity from the charge power supply to the second charge member.

6. The image forming apparatus according to claim wherein when the control unit controls the potential formation unit to form the second electric field at the first transfer portion and the second transfer portion, the toner image is transferred from the first image-bearing member toward the belt at the first transfer portion and is transferred from the second image-bearing member toward the belt at the second transfer portion.

7. The image forming apparatus according to claim wherein when the control unit controls the potential formation unit to form the second electric field at the first transfer portion and the second transfer portion, the first toner transferred to the belt is moved from the belt to the second image-bearing member at the second transfer portion and the toner image is transferred from the first image-bearing member toward the belt at the first transfer portion.

8. The image forming apparatus according to claim 1 further comprising:

image-bearing members including the first image-bearing member and the second image-bearing member, wherein the first image-bearing member and the second image-bearing member are adjacent to each other in the direction in which the belt moves, and the second image-bearing member is disposed most downstream of the image-bearing members.

9. The image forming apparatus according to claim 8 further comprising:

a collection unit that collects the toner transferred to the belt, wherein the control unit controls the second charge member such that a charged second toner that attaches to the second charge member and that has the second polarity is moved to the second image-bearing member, and controls the potential formation unit to form the first electric field to transfer the second toner from the second image-bearing member to the belt, and wherein the second toner transferred to the belt is collected by the collection unit.

10. The image forming apparatus according to claim wherein, when a first image is formed and a second image is continuously formed after the first image is formed, the control unit controls the potential formation unit after a toner image corresponding to the first image is transferred from the second image-bearing member toward the belt such that the first electric field is formed at the first transfer portion to transfer the first toner from the first image-bearing member to the belt, and controls the potential formation unit after the first toner is transferred from the first image-bearing member to the belt such that the second electric field is formed at the first transfer portion to transfer a toner image corresponding the second image from the first image-bearing member toward the belt.

11. The image forming apparatus according to claim 10, wherein the control unit controls the potential formation unit such that the toner image corresponding to the second image is transferred from the first image-bearing member toward the belt after the second electric field is formed at the second transfer portion.

12. The image forming apparatus according to claim 1 further comprising:

a first contact member that is in contact with an inner circumferential surface of the belt at a position corresponding to the first transfer portion; and a second contact member that is in contact with the inner circumferential surface of the belt at a position corresponding to the second transfer portion, wherein the potential formation unit is a power supply that applies voltages having the same polarity to the first contact member and the second contact member.

13. The image forming apparatus according to claim 1, wherein the belt is an intermediate transfer belt, each toner image borne by the first image-bearing member and the second image-bearing member is primarily-transferred from the first image-bearing member and the second image-bearing member to the intermediate transfer belt and is subsequently secondary-transferred from the intermediate transfer belt to a transfer material.

14. The image forming apparatus according to claim 13 further comprising:

a secondary transfer member that is in contact with an outer circumferential surface of the intermediate transfer belt and that forms a secondary transfer portion; and wherein the potential formation unit is a power supply that applies a voltage to the secondary transfer member to cause the toner image to be transferred from the intermediate transfer belt to the transfer material at the secondary transfer portion, wherein the control unit controls the power supply to form the electric fields in the same direction at the first transfer portion and the second transfer portion by applying a voltage to the secondary transfer member.

15. The image forming apparatus according to claim 1, wherein the belt is a conveying belt that conveys a transfer material, and each toner image borne by the first image-bearing member and the second image-bearing member is superposed in order on the transfer material conveyed by the conveying belt and transferred thereto.

16. The image forming apparatus according to claim 1, wherein a blade that is in contact with the second image-bearing member is not disposed between the second transfer portion and a position at which the second image-bearing member and the second charge member are in contact with each other with respect to a direction in which the second image-bearing member rotates.

17. The image forming apparatus according to claim 1 further comprising:

a first transfer member configured to transfer a toner image from the first image-bearing member toward the belt; and a second transfer member configured to transfer a toner image from the second image-bearing member toward the belt, wherein the potential formation unit is a power supply that applies a voltage to the first transfer member and the second transfer member, and wherein the control unit controls the power supply to form the electric fields in the same direction at the first transfer portion and the second transfer portion by applying a voltage to the first transfer member and the second transfer member.

* * * * *